US012503840B2

(12) United States Patent
Rothschild

(10) Patent No.: US 12,503,840 B2
(45) Date of Patent: Dec. 23, 2025

(54) CLEANING APPARATUS AND A METHOD FOR CLEANING OF HAND OF A USER

(71) Applicant: Leigh Rothschild, Miami, FL (US)

(72) Inventor: Leigh Rothschild, Miami, FL (US)

( * ) Notice: Subject to any disclaimer, the term of this patent is extended or adjusted under 35 U.S.C. 154(b) by 0 days.

(21) Appl. No.: 18/648,126

(22) Filed: Apr. 26, 2024

(65) Prior Publication Data

US 2025/0333941 A1 Oct. 30, 2025

(51) Int. Cl.
*E03C 1/18* (2006.01)
*A47K 5/12* (2006.01)

(52) U.S. Cl.
CPC ..... *E03C 1/18* (2013.01); *A47K 5/1217* (2013.01)

(58) Field of Classification Search
CPC .. A47K 2210/00; A47K 5/1217; E03C 1/057; G08B 21/245
See application file for complete search history.

(56) References Cited

U.S. PATENT DOCUMENTS 5,924,148 A * 7/1999 Flowers, Sr. ..... A47K 10/48 4/619
7,228,874 B2 * 6/2007 Bolderheij ..... E03C 1/055 222/145.5
11,295,629 B1 * 4/2022 Peets ..... G01N 33/1893
2011/0146800 A1 * 6/2011 Jallon ..... C02F 9/20 4/597
2017/0322197 A1 * 11/2017 Hall ..... G01N 33/493
2018/0106021 A1 * 4/2018 Hall ..... E03C 1/055
2018/0221527 A1 8/2018 Riggio et al.
2021/0369881 A1 * 12/2021 Hayden ..... A61L 2/0023

FOREIGN PATENT DOCUMENTS

CN 104655008 A 5/2015
CN 112137481 A * 12/2020 ..... A47K 10/48
IN 202011033597 A 8/2020
IN 202241021280 A 4/2022

(Continued)

*Primary Examiner* — Erin Deery
(74) *Attorney, Agent, or Firm* — Dobbin IP Law, P.C.; Geoffrey E. Dobbin

(57) ABSTRACT

A method for a cleaning apparatus represents groundbreaking advancement in hand hygiene technology. Users can personalize cleaning routine by selecting from modes such as thorough, regular, or quick wash, with facial ID recognition or voice recognition ensuring a tailored experience based on individual preferences. The apparatus employs movable nozzles and predefined spraying patterns for systematic and consistent hand cleaning. Advanced feedback mechanisms, including audio, visual, and haptic signals, keep users informed throughout the process. Cleaning apparatus beyond conventional hand-cleaning methods by integrating soap and lotion dispensing units, a drying element, UV sterilization, and self-cleaning capabilities. These features collectively elevate hygiene standards, providing users with a comprehensive solution for maintaining optimal hand cleanliness. Health monitoring is seamlessly integrated, with image sensors detecting unusual patterns such as blood stains or tumors, triggering timely alerts for users to seek professional advice. A comprehensive self-cleaning mode is activated when the user is away.

18 Claims, 7 Drawing Sheets

(56) References Cited

FOREIGN PATENT DOCUMENTS

| | | | | | |
|---|---|---|---|---|---|
| TR | 202013604 | U5 | 8/2021 | | |
| TW | M591832 | U | 3/2020 | | |
| WO | WO-2019104175 | A1 * | 5/2019 | ..... | E03C 1/057 |
| WO | WO-2021148099 | A1 * | 7/2021 | | |
| WO | WO-2022074407 | A1 * | 4/2022 | ..... | A47K 10/48 |

* cited by examiner

CLEANING APPARATUS AND A METHOD FOR CLEANING OF HAND OF A USER

TECHNICAL FIELD

The present disclosure is related in general to personal hygiene and cleaning technology. More specifically, the disclosure relates to a cleaning apparatus designed for cleaning hands through the controlled and customizable dispensing of water, soap, and lotion. Additionally, this disclosure details an apparatus and method that will self-clean the sink. The disclosure also includes additional functionalities like communication with electronic devices, dispensing of soap and lotion based on user preferences, drying elements, UV sterilization and even detection of unusual patterns on the user's hands.

BACKGROUND

Hand hygiene stands as a crucial element in preserving personal health and preventing the transmission of infections. Traditional handwashing methods, involving manual application of water and soap, exhibit limitations in customization, efficiency, and user experience. Technological advancements have paved the way for innovative solutions to elevate the hand-cleaning process. Conventional handwashing systems often lack customization options, fail to identify users, and may result in inconsistent cleaning patterns. The manual nature of traditional handwashing further contributes to inefficiencies, with a lack of effective feedback mechanisms for users. Additionally, these methods don't offer insights into health aspects. The 2000 worldwide Covid epidemic clearly demonstrated the need for efficient and effective handwashing solutions to prevent the spread of this and other diseases.

Typically, users manually rub their hands together under running water with soap in a process that lacks customization options. The intensity and duration of washing are not tailored to individual preferences, resulting in a non-uniform experience for all users. Moreover, there is no mechanism for user identification, and the lack of feedback mechanisms can cause uncertainty about the thoroughness of the hand-cleaning process. Traditional methods also miss incorporating advanced features like soap/lotion dispensing, UV sterilization, and self-cleaning capabilities. While touchless systems with automated sensors exist, they often lack customization options for users and fail to provide inherent user identification or personalization. Limited feedback mechanisms, relying on visual cues like water flow, further contribute to their drawbacks. Additionally, separate UV sterilization devices require independent use, lacking integration with a comprehensive hand-cleaning system and leading to additional steps for users. Even in facilities with automated hand dryers, the focus is primarily on drying hands, lacking additional features such as lotion dispensing or UV sterilization, and offering no customization options for users in terms of drying duration or preferred temperature. Thus, there is a need for a better more effective solution for hand washing and hand sterilization.

Conventional handwashing methods suffer from a lack of personalization, employing a one-size-fits-all approach to cleaning. These systems do not incorporate mechanisms for user identification, leading to inconsistent cleaning patterns and varying levels of effectiveness. Additionally, the absence of effective feedback mechanisms leaves users unaware of the correct completion of the cleaning process. Health monitoring capabilities are also absent in traditional handwashing systems, and their energy efficiency and self-cleaning capabilities are often inadequate.

IN202011033597A discloses a system of AI-Based Wash-basin System. This system incorporates a lower compartment with wheels and an upper compartment housing essential features such as a smart tap, sanitizer dispenser, soap dispenser, smart/intelligent drawer, smart dustbin, urinate plate, headlamp, five-mode light, and OLEDs for display. The smart tap is designed to dynamically adjust water flow based on hand size, ensuring efficient usage. Touchless operation is a key feature, with the sanitizer and soap dispensers activated without physical contact. The smart drawer opens post-handwashing, featuring an alarm for medication access. The smart dustbin employs a sensor-activated flap for hands-free garbage collection, while the urinate plate adds user convenience. Control and monitoring mechanisms include an intelligent drawer operated by a rack and pinion system, a smart dustbin with an ultrasonic sensor for obstacle detection, headlamp activation dependent on ambient light during user calls, and OLEDs displaying diverse information, including a stop button for system control. The present disclosure differentiates from IN202011033597A. Present disclosure specifically discloses a Hand Cleaning Apparatus and sink cleaning. This apparatus comprises nozzles for dispensing water, soap, or lotion, sensors for user identification utilizing image sensors or proximity sensors, a water supply unit, a processor, a computer-readable medium, and a communication unit facilitating connection to the user's electronic device. Additional features include soap and lotion dispensing units, a drying element heater, and UV lighting elements. User-centric functionalities encompass customizable cleaning preferences (thorough, regular, quick) and predefined patterns of water, soap, or lotion based on user input. Feedback is provided to the user after washing or drying cycles. The system includes a self-cleaning mode activated when the user is away, and unusual patterns detection is achieved using image sensors and machine learning. Optional features consist of a rolling cover for sealing during the sink cleaning cycle, user configuration operations for personalized preferences, and a microphone for receiving user instructions.

US2018221527A1 discloses a sanitation method and system that involves a comprehensive setup comprising a sink, dispenser, sensor, and an electronic multifunction device. Activation of the sink or dispenser is detected by the sensor, initiating a sanitation module on the electronic device. Two system variations are presented: the first, involving a sink, dispenser, and electronic device and the second encompassing a sink, dispenser, dryer, and electronic device. In terms of functionality, the electronic multifunction device boasts both input and output capabilities, potentially featuring a touchscreen display. The sanitation module dynamically adjusts operations based on user identification. The sensor actively monitors and transmits data regarding water usage or the dispensing of sanitation materials. Furthermore, the output device issues alerts to the user if the time elapsed between activation and ending events falls below a predetermined threshold. In contrast to US2018221527A1 the present disclosed cleaning apparatus introduces a distinct approach. This apparatus is equipped with movable nozzles, sensors for user identification, a water supply unit, a processor, and a feedback mechanism. Notably, various cleaning modes (thorough, regular, quick) are associated with predefined spraying patterns, offering users flexibility. The system employs image sensors to discern hand positions during washing and drying cycles, with the nozzles adjusting accordingly. User interaction is a focal point for the cleaning apparatus, with facial recognition techniques employed for user identification. The system offers alerts and audio-visual greetings based on the user's presence. Additionally, a default self-cleaning mode activates when the user is away for a predetermined period, involving the application of hot water and/or cleaning fluid. The apparatus is equipped with image sensors that utilize machine learning techniques to detect unusual patterns on the user's hand, such as blood stains, vein issues, dermatology issues, or tumors. User operations are facilitated through a software application installed on the user's electronic device, allowing for customization of various preferences. A built-in microphone enables users to provide instructions for seamless interaction with the apparatus. In essence, while the sanitation system focuses on adaptive functionality based on user activities, the cleaning apparatus emphasizes user-specific cleaning modes, health monitoring, and self-cleaning capabilities.

TWM591832U discloses a Smart Washbasin with IoT Functionality, providing insights into its fundamental components and functionalities. This intelligent washbasin integrates modules for flow rate sensing, water level sensing, and infrared sensing. It possesses the capability to perceive and regulate essential parameters such as water flow speed, detergent level, and the presence of mosquitoes. The communication technology employed for wireless data transmission is Bluetooth, and its power source is derived from a lithium battery specified in the power module. Noteworthy features include the deployment of sensors for detecting detergent levels, mosquito positions, and water flow speed. The integration of IoT is a key highlight, enabling remote monitoring and control. In contrast to TWM591832 the present disclosure specifically discloses a cleaning apparatus with User Identification and Feedback. The components of this apparatus encompass various features, including nozzles, sensors, a water supply unit, processor, communication unit, and more. The emphasis is on the apparatus's functionality, particularly its capacity to dispense water, soap, and lotion based on user input. It seamlessly integrates user identification, delivers feedback post-cycles, and introduces a self-cleaning mode. User interaction is facilitated through user-configurable preferences, including the integration of a microphone for instructions. The apparatus prioritizes safety and health features by incorporating UV lighting for hand sterilization and the detection of unusual medical patterns for health monitoring. Furthermore, it possesses the capability to transmit alerts to the user's device based on identified patterns.

IN202241021280A discloses the Smart Multi-Meter Hand Sanitization System, which is tailored for hand sanitization and health monitoring, centering around features such as a camera, infrared sensors, temperature sensors and a pulse oximeter for comprehensive health assessment. Its primary functionality involves dispensing a predetermined quantity of sanitizing solution based on the user's distance and monitoring health parameters like temperature, oxygen saturation, and heart rate. In case of deviations from predefined values, the system displays messages about abnormalities. Key components include a camera, sanitizer dispenser, infrared sensor, infrared temperature sensor, pulse oximeter sensor and a control unit with a predominant focus on health-related measurements and sanitizer dispensing. In contrast to IN202241021280A the present disclosure specifically discloses a cleaning apparatus. Cleaning apparatus is designed specifically for hand cleaning using water, soap, and lotion. Its key features encompass movable nozzles, user identification sensors, and various dispensing units. The primary functionality revolves around spraying water, soap, or lotion in a predefined pattern based on user input and providing feedback post-washing or drying cycles. Components include nozzles, pump, sensors, water supply unit, processor, communication unit, dispensing units, drying element, UV lighting elements, and image sensors. The emphasis here is on customizable hand-cleaning features, with additional functionalities such as drying and sterilization. In essence, while both systems address personal hygiene, the former prioritizes health-centric aspects, whereas the latter focuses on customizable hand-cleaning features and supplementary functionalities including sink cleaning.

CN104655008A discloses a detection system for CCD Sensors, primarily designed for industrial applications. The system encompasses components such as a measurement industrial computer, motor control module, printout module, power module and alarm module, laser beam emitting device, motor drive module, servomotor, CCD sensor, Signal-regulated kinase, determined, and detection lens. Functionally, these components collaborate to facilitate measurement and detection processes utilizing a CCD sensor, incorporating elements like motor control, laser emission, and feedback through various modules. In contrast to CN104655008A the present disclosure discloses the cleaning apparatus intended for personal hand hygiene and sterilization purposes. The apparatus is equipped with components such as nozzles, sensors, a water supply unit, processor, computer-readable medium, communication unit, soap and lotion dispensing units, drying element, UV lighting elements, rolling cover, and microphone. The apparatus is designed to receive user input, identify the user, and execute hand-cleaning processes, including spraying water, soap, or lotion in specific patterns. It also provides feedback to the user and includes additional features like soap/lotion dispensing, drying, UV sterilization, and user identification.

TR202013604U5 discloses Handwashing Unit (A) is characterized by essential features such as a motion sensor, voice guidance system, hand sensor, water nozzle, soap nozzle, and video display. Its primary focus lies in guiding users through the handwashing process, utilizing motion detection and visual/auditory aids. Users interact with the unit to access water, soap, and guidance, making it a functional and straightforward solution for effective hand hygiene. In contrast to TR202013604U5 the present disclosure specifically discloses a cleaning apparatus which represents a more advanced and comprehensive approach to personal hygiene. It incorporates features such as personalized modes, facial ID recognition, movable nozzles, advanced feedback mechanisms, soap and lotion dispensers, a drying element, UV sterilization, self-cleaning capabilities, and health monitoring with image sensors. This apparatus offers a holistic solution that goes beyond traditional handwashing, allowing users to tailor their cleaning routine. It provides real-time feedback through various sensory signals, making it an innovative and user-centric system that elevates hygiene and cleaning standards.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

The forgoing summary is illustrative only and is not intended to be in any way limiting. In addition to the illustrative aspects, embodiments, and features described above, further aspects, embodiments, and features will become apparent by reference to the drawings and the following detailed description.

In an embodiment, a cleaning apparatus comprising one or more nozzles configured to spray at least one of water, soap, and lotion using a pump is disclosed. In an embodiment, the one or more nozzles are movable, and one or more sensors are configured to identify a user using the cleaning apparatus. In an embodiment, the one or more sensors comprises at least one of image sensors or proximity sensors. The water supply unit is connected to a water supply inlet and further to the one or more nozzles. The computer-readable medium is communicatively coupled to the processor. In an embodiment, the computer-readable medium stores processor-executable instructions, which when executed by the processor, causes the processor to receive an input from a user for cleaning of hand. In an embodiment, the input is indicative of at least one of a thorough sanitizing cleaning, a regular cleaning, and a quick wash. In an embodiment, the computer-readable medium stores processor-executable instructions, which when executed by the processor, cause the processor to spray at least one of water, soap, and lotion using the one or more nozzles in a pre-defined pattern on the hand of the user. In addition, an Ultraviolet (UV) light key be utilized to further sanitize the user's hands. In an embodiment, the pre-defined pattern may be associated with each of the inputs and the system provides feedback to the user after a washing cycle or drying cycle is completed.

In an embodiment, the cleaning apparatus comprises a communication unit configured to an electronic device of the user. The cleaning apparatus comprises a soap dispensing unit configured to dispense soap on the hand of the user based on the input during washing of the hand. The cleaning apparatus comprises a lotion dispensing unit configured to dispense lotion on the hand of the user based on the input during washing of the hand. The cleaning apparatus comprises a drying element configured to dry one or more hands or objects placed within the cleaning apparatus. In an embodiment, the drying element is a heater. The cleaning apparatus comprises one or more UV lighting elements configured to sterilize the hand of the user after washing. In an embodiment, a plurality of jets of hot air and UV light are being directed towards the hands of the user. In an embodiment, the one or more image sensors being configured to determine a position of the hands during a washing cycle and a drying cycle. In an embodiment, the one or more nozzles being configured to move in accordance with the position of the hands during the washing cycle and the drying cycle. In an embodiment, feedback may comprise an audio feedback, a visual feedback, a haptic feedback, or a combination thereof.

In an embodiment, the identification of the user is using one or more facial recognition techniques. In an embodiment, at least one of the image sensors or the proximity sensors being configured to detect a presence of the user near the cleaning apparatus. In an embodiment, a speaker being configured to provide an audio-visual alert to the user. In an embodiment, the audio-visual alert corresponds to one of a welcome greeting to the user or a goodbye to the user. In an embodiment, when the user is away from the cleaning apparatus then the cleaning apparatus is by default in self-cleaning mode for a pre-determined time interval or if imaging determines that the cleaning is needed. In an embodiment, based on a structure of the cleaning apparatus, the cleaning apparatus is configured to either spray hot water and/or cleaning fluid from the one or more nozzles that are positioned to remove dirt from the cleaning apparatus. In an embodiment, the one or more nozzles are micro driven and arranged to be positioned to spray where the dirt is located in the cleaning apparatus based on the imaging that has been received by the processor.

In an embodiment, the pre-determined time interval being determined based on the amount of dirt present in the cleaning apparatus using one or more image sensors and the one or more machine learning techniques. In an embodiment, the one or more sensors being also configured to detect hand movements within the cleaning apparatus. In an embodiment, the cleaning apparatus comprises a rolling cover that is driven by a micro motor that closes a top portion of the cleaning apparatus to make the cleaning apparatus into a sealed container. In an embodiment, the rolling cover is deployed and retracted during a cleaning cycle. In an embodiment, the one or more image sensors being configured to detect one or more unusual patterns on the hand of the user using one or more machine learning techniques. In an embodiment, one or more unusual patterns comprises blood stains, vein patterns, dermatology issues, tumor, mucus, or melanoma, wherein the one or more unusual patterns being stored in a database.

In an embodiment, the cleaning apparatus comprises providing an alert to the user on an electronic device via the communication unit. In an embodiment, the alert is indicative of the detected one or more unusual patterns. In an embodiment, the alert is at least one of an SMS, a push notification, or an email. In an embodiment, one or more operations of the cleaning apparatus is being controlled by a software application installed within an electronic device of the user. In an embodiment, the user performs a plurality of configuration operations associated with the cleaning apparatus. In an embodiment, the plurality of configuration operations comprises providing a facial id for registration with the cleaning apparatus and providing a plurality of preferences associated with temperature of water, soap, lotion, audio, duration of time for handwashing, preferred time instant for self-cleaning of the cleaning apparatus, frequency of cleaning the cleaning apparatus, alerts, including medical alerts, language, number of users, duration of time for UV lighting during handwashing, filters for screening, intensity of water. In an embodiment, the cleaning apparatus comprises a microphone configured to receive one or more instructions. In an embodiment, the cleaning apparatus is operated by electricity. In an embodiment the sink may also contain a display panel to allow the user to control the sink or provides directions with text or video for the user of the sink. This display panel may be an LED array, lcd array, or an OLED array or any other type of display currently known, or future known in the art. The display may be touch sensitive or linked to voice commands.

In an embodiment, a method for cleaning of hand of a user, the method comprises receiving an input from a user for cleaning of hand. In an embodiment, the input is indicative of at least one of a thorough sanitizing cleaning, a regular cleaning, and a quick wash. The method comprises identification of a user using the cleaning apparatus. In an embodiment, the identification is using one or more sensors that comprises at least one of image sensors or proximity sensors. The method comprises spraying at least one of water, soap, and lotion using one or more nozzles in a pre-defined pattern on the hand of the user. In an embodiment, the pre-defined pattern being associated with each of the inputs. In an embodiment, the one or more nozzles being configured to spray at least one of water, soap, and lotion using a pump. In an embodiment, the one or more nozzles are movable and the method for cleaning of hand of a user, the method comprises providing one or more feedback messages to the user after a washing cycle or drying cycle is completed. The method for cleaning the hand of the user comprises determining a position of the hands during a washing cycle and a drying cycle. In an embodiment, the one or more nozzles being configured to move in accordance with the position of the hands during the washing cycle and the drying cycle. In an embodiment, the one or more image sensors being configured to detect one or more unusual patterns on the hand of the user using one or more machine learning techniques. In an embodiment, one or more unusual patterns comprises blood stains, vein patterns, dermatology issues, tumor, mucus, or melanoma. In an embodiment, the one or more unusual patterns being stored in a database. The method for cleaning of hand of the user comprises providing an alert to the user on an electronic device via the communication unit. In an embodiment, the alert is indicative of the detected one or more unusual patterns. In an embodiment, the alert is at least one of an SMS, a push notification, or an email. In an embodiment, the plurality of configuration operations comprises detecting dirt in the sink to initiate a cleaning cycle at scheduled intervals. In an embodiment, water is prevented from escaping during the cleaning process. In an embodiment, the motorized lid of the cleaning apparatus moves into position to seal the sink. In an embodiment, a tight seal over the sink is created to contain water and cleaning agents within the cleaning apparatus. In an embodiment, a combination of soap, high pressure water jets, and a mixture of hot and cold water to effectively clean the sink is utilized. The water jets are directed to target specific areas with accumulated dirt or grime. In an embodiment, CCD imaging technology identifies areas in the sink that require cleaning. In an embodiment, cleaning cycle continues until sink is thoroughly cleaned, with the water jets and cleaning agents working together to remove dirt and stains from all surfaces. Once the cleaning cycle is complete, completion notification is received. In an embodiment, the user is notified via communication, indicating that the sink is now clean and ready for further use.

The disclosure is a technologically advanced cleaning apparatus designed to revolutionize hand hygiene practices. Users can choose between thorough, regular, or quick wash options, tailoring the cleaning process to individual preferences. The apparatus employs movable nozzles and predefined spraying patterns for consistent and efficient cleaning. Advanced sensors, including image sensors and proximity sensors, uniquely identify users for a personalized hand-cleaning experience. User-specific preferences, such as water temperature and soap/lotion type, can be stored and recalled for future use. Movable nozzles and predefined patterns automate the hand-cleaning process, ensuring systematic and thorough cleaning. Audio, visual, and haptic feedback mechanisms inform users of the completion of washing or drying cycles. Soap and lotion dispensing units provide additional cleansing options. A drying element, UV sterilization, and self-cleaning capabilities enhance overall hygiene standards. Image sensors detect unusual patterns on the user's hands, such as blood stains, vein patterns, and dermatology issues. Tumors, mucus, or melanoma. Detected patterns can be stored in a database, and users receive alerts for potential health issues. A communication unit enables interaction with electronic devices, providing alerts and notifications. The cleaning apparatus can be controlled and configured through a software application installed on users' electronic devices. A self-cleaning mode is activated when the user is away, addressing concerns of cleanliness and energy efficiency. The cleaning apparatus includes a rolling cover for sealing and protecting the unit during self-cleaning cycles. A microphone allows users to provide instructions, enhancing user interaction. The cleaning apparatus operates on electricity for efficient and consistent performance. Users can perform various configuration operations, including providing facial ID for registration and setting preferences for water temperature, soap, lotion, audio, and more. Unusual patterns detected on the user's hands trigger health alerts, providing valuable health monitoring. Detected patterns are stored in a database for future reference and analysis. The present disclosure encompasses a comprehensive and innovative approach to hand hygiene, addressing customization, user identification, and automation, feedback, advanced hygiene features, health monitoring, and energy efficiency. The integration of these features into a single cleaning apparatus aims to provide users with a sophisticated, user-centric, and technologically advanced solution for maintaining optimal hand hygiene, which previously did not exist in commerce or art.

BRIEF DESCRIPTION OF DRAWINGS

The accompanying drawings illustrate the various embodiments of methods and other aspects of the disclosure. Any person with ordinary skills in the art will appreciate that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa. Further, the elements may not be drawn to scale.

Various embodiments will hereinafter be described in accordance with the appended drawings, which are provided to illustrate and not to limit the scope in any manner. In an embodiment, similar designations denote similar elements, and in which.

DETAILED DESCRIPTION

Figure 1:
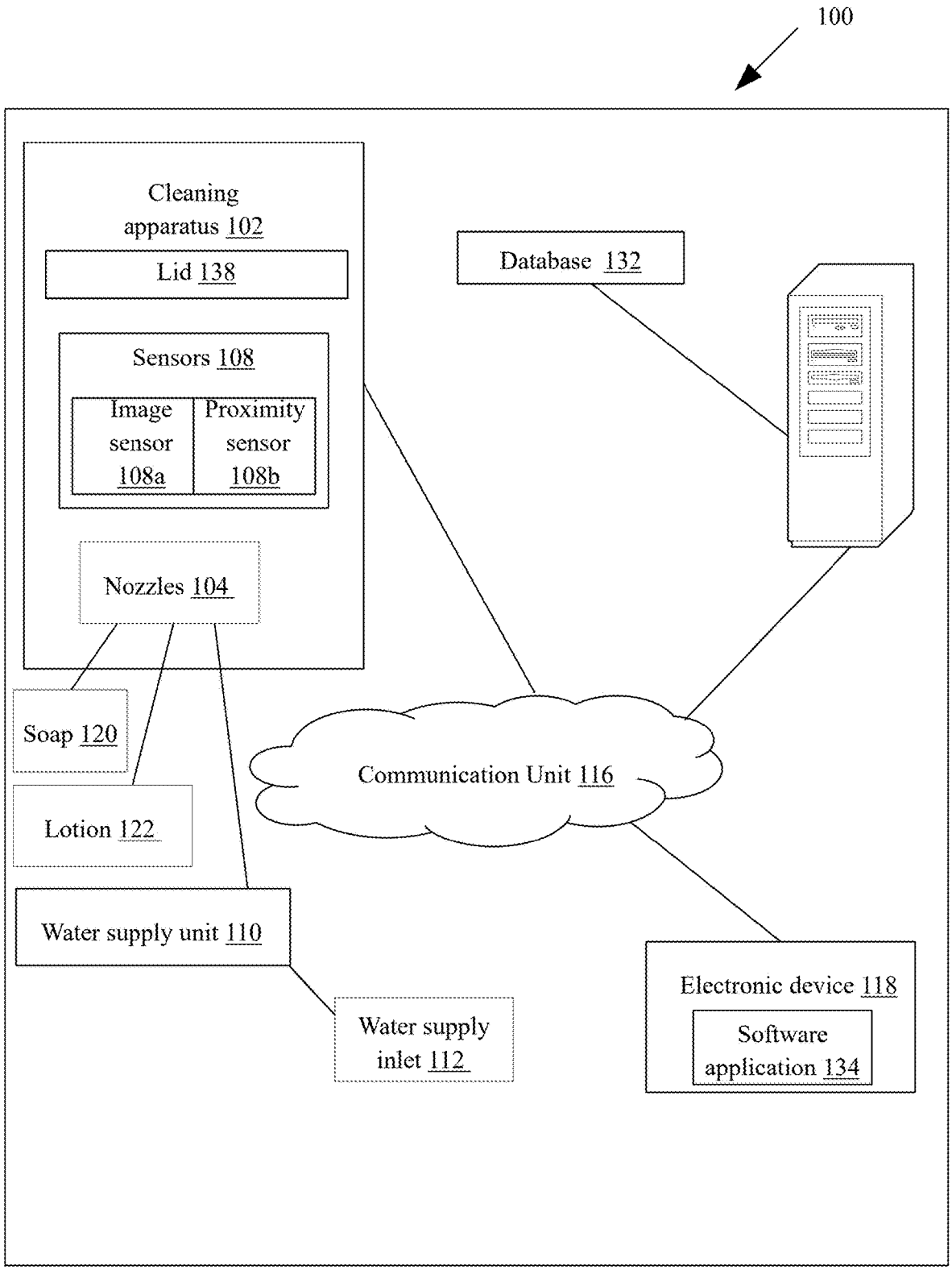
FIG. 1 is a block diagram that illustrates a system environment in which various embodiments of the method may be implemented.

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the method may extend beyond the described embodiments. For example, the teachings presented, and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

The primary objective of the disclosure is to provide users with a customizable and user-centric hand-cleaning experience by allowing them to choose between different cleaning modes (thorough, regular, quick wash). Another objective is to implement advanced sensors (image sensors, proximity sensors) to uniquely identify users and personalize the hand-cleaning process based on individual preferences. Another objective of the disclosure is to introduce automation through movable nozzles and predefined spraying patterns to ensure a systematic, efficient, and consistent hand-cleaning process. One more objective of the disclosure is to incorporate audio, visual, and haptic feedback mechanisms to inform users of the completion of washing or drying cycles, enhancing user awareness and engagement. Another objective of the disclosure is to integrate soap and lotion dispensing units, a drying element, UV sterilization, and self-cleaning capabilities to elevate hygiene standards and provide users with comprehensive cleaning options. Another objective of the disclosure is to utilize image sensors to detect unusual patterns on the user's hands, including potential health indicators such as blood stains, tumors, vein patterns, mucus, or melanoma, and provide timely alerts to users. One another objective of the disclosure is to enable communication with electronic devices, allowing users to receive alerts, notifications, and control the cleaning apparatus through a dedicated software application. Yet another objective of the disclosure is to implement a self-cleaning mode for the washing chamber, which is activated when the user is away, to ensure cleanliness and energy efficiency, addressing maintenance concerns. Another objective of the disclosure is to incorporate a microphone for users to provide instructions, enhancing the overall interaction and user control over the cleaning apparatus. Also, the disclosure allows users to perform various configuration operations, including facial ID registration and setting preferences for water temperature, soap, lotion, audio, and other parameters. The present disclosure also provide health alerts based on detected unusual patterns and stores this information in a database for future reference and analysis. The objective of the present disclosure is to design the cleaning apparatus to be user-friendly, with intuitive controls, clear feedback, and a seamless overall operation. Yet another objective of the disclosure is to introduce cutting-edge technologies and features to the field of hand hygiene, positioning the disclosure as a technologically advanced solution.

In summary, the objectives of the present disclosure is to encompass delivering an advanced, user-friendly, and comprehensive hand-cleaning and sink cleaning solution that goes beyond traditional methods, addressing customization, user identification, feedback, advanced hygiene, health monitoring, and energy efficiency.

FIG. 1 is a block diagram that illustrates a system environment 100 in which various embodiments of the method and the cleaning apparatus 102 may be implemented. System environment 100 typically includes a cleaning apparatus 102. The cleaning apparatus 102 comprises nozzles 104, sensors 108, further sensors comprises image sensor 108*a* and proximity sensor 108*b*, water supply unit 110, water supply inlet 112, other liquid reservoirs 120, 122, communication unit 116, database 132, electronic device 118, further electronic device comprises software application 134. A lid 138 is also provided to seal the apparatus for self-cleaning.

The cleaning apparatus 102 refers to a technologically advanced and innovative device designed for the purpose of hand hygiene. The apparatus is equipped with one or more movable nozzles capable of spraying water, soap, and lotion. These nozzles are driven by a pump system, allowing for precise control over the dispensing of cleansing agents. The cleaning apparatus 102 incorporates one or more sensors for user identification and interaction. These sensors may include image sensors 108*a* for facial recognition and proximity sensors 108*b* to detect the presence and movements of the user. A water supply unit 110 is connected to a water supply inlet 112 and the one or more nozzles 104. This ensures a constant and controlled supply of water for the cleaning process.

Sensor 108 is a device or instrument designed to detect and measure physical properties or changes in the environment and convert this information into signals or data. Sensors 108 play a crucial role in various technological applications, enabling the collection of data for analysis, control, and monitoring. There are numerous types of sensors 108, each designed to detect specific physical phenomena, such as light, temperature, motion, proximity, or images.

Image Sensor 108*a* is a specific type of sensor 108 that captures visual information and converts it into an electronic signal. It is commonly used in cameras and imaging devices to capture images or video. Image sensors 108*a* are crucial components in digital cameras, smartphones, surveillance cameras and other devices that require visual data capture. Image sensors 108*a* are also utilized for facial recognition to identify users. Image sensors 108*a* also play a role in health monitoring by capturing visual information to detect unusual patterns on the user's hands.

Proximity sensor 108*b* a proximity sensor 108*b* is a type of sensors 108 that detects the presence or absence of an object or the proximity of an object within a certain range. Proximity sensors 108*b* are commonly used in electronic devices 118 to trigger actions when an object is nearby or to adjust settings based on the distance between the sensor 108 and an object. There are different types of proximity sensors 108*b*, and two common ones are infrared (IR) Proximity Sensor: IR proximity sensors emit infrared light and measure the reflection to determine the presence or absence of an object. These sensors 108 are often used in applications where contactless detection is required. Ultrasonic proximity sensors use sound waves to detect objects. They emit ultrasonic waves and measure the time it takes for the waves to bounce back. These sensors are suitable for applications where accurate distance measurements are needed.

In the cleaning apparatus 102, proximity sensors 108*b* are described as being used for user identification, detecting the presence of the user near the device, and potentially for detecting hand movements within the cleaning apparatus 102. They contribute to the overall user interaction and personalization features of the device.

A water supply unit 110, as mentioned in the context of the cleaning apparatus 102, refers to a component responsible for providing a controlled and consistent supply of water to the system. In the disclosure, the water supply unit 110 is a crucial element to ensure that the cleaning apparatus 102 can dispense water in accordance with user preferences and the selected cleaning mode. The water supply unit 110 is designed to connect to an external water source through a water supply inlet 112. This connection allows the cleaning apparatus 102 to receive a continuous flow of water, ensuring that the device has an adequate and constant supply during the cleaning process. The water supply unit 110 is equipped with mechanisms to control the flow of water. This control ensures that the water is dispensed in a regulated manner, meeting the requirements of the selected cleaning mode and user preferences.

The water supply unit 110 is connected to the one or more nozzles of the cleaning apparatus 102. These nozzles 104 are responsible for spraying water onto the user's hands in a predefined pattern, contributing to the effectiveness and efficiency of the hand-cleaning process. In coordination with the pump system mentioned in the disclosure, the water supply unit 110 ensures that the water is pressurized and delivered through the nozzles 104. The pump 106 system may be responsible for pumping water, soap, or lotion, depending on the chosen cleaning mode. Water supply units 110 may include mechanisms for temperature control. This allows the cleaning apparatus to dispense water at a specific temperature, meeting user preferences for a comfortable and customized hand-cleaning experience. The water supply unit 110 needs to be reliable and durable to withstand continuous use and deliver consistent performance over time. The water supply unit 110 should be designed to handle water pressure and flow requirements without malfunctioning.

Depending on the design, the water supply unit 110 may incorporate safety features to prevent issues such as leaks or excessive pressure. These features contribute to the overall safety and reliability of the cleaning apparatus. The water supply unit 110 in the cleaning apparatus 102 ensures a reliable and controlled flow of water, which is a fundamental element for the effective operation of the hand-cleaning process. The water supply unit 110 works in conjunction with other components, such as the pump 106 system and nozzles 104, to provide users with a customizable and efficient hand-cleaning experience.

The water inlet 112, as mentioned in the context of the cleaning apparatus 102, serves as the point of connection between the device and an external water source. It is a crucial component for ensuring a constant and controlled supply of water 110 to the system. While specific details about the water supply inlet 112 in the provided information are limited, here is a general description of the features and functions associated with a water inlet. The water supply inlet 112 is typically designed as a port or connection point on the cleaning apparatus 102. It may have a threaded or quick-connect design, allowing it to attach securely to a corresponding water supply unit 112. The primary function of the water supply inlet 112 is to connect the cleaning apparatus 102 to an external water source. This external source could be a water supply line or any other water reservoir capable of providing the required water pressure and flow. The supply water inlet may be connected to a hose or pipe that extends to the external water source. This hose facilitates the transportation of water from the source to the cleaning apparatus 102. The water inlet may incorporate valves or other control mechanisms to regulate the flow of water entering the cleaning apparatus 102. This regulation is important for ensuring that the device receives an appropriate and controlled amount of water during the hand-cleaning process. The design of the water supply inlet considers compatibility with standard plumbing systems. This allows users to connect the cleaning apparatus 102 to common water supply sources found in homes, offices, or other settings. Some water inlets may feature threaded connections to facilitate a secure and leak-proof attachment. Threaded connections are commonly used in plumbing applications and provide a reliable seal. The water supply inlet 112 is designed to handle a range of water pressures commonly encountered in domestic or commercial water supplies. This ensures that the cleaning apparatus 102 functions optimally without being affected by variations in water pressure.

The construction material of the water supply inlet 112 is chosen for durability and resistance to corrosion. Common materials include brass, stainless steel, or other corrosion-resistant alloys. The water supply inlet may include a sealing mechanism, such as rubber gaskets or O-rings, to prevent water leakage and ensure a tight seal between the cleaning apparatus and the water source. It is important to note that the specific design and features of the water inlet can vary based on the engineering and manufacturing choices made for the cleaning apparatus 102. The water supply inlet 112 is an essential component that facilitates the reliable and controlled supply of water required for the efficient operation of the hand-cleaning and sink cleaning process.

Electronic device 118 refers to a device that utilizes electronic components and technology to perform specific functions or tasks. These devices typically incorporate electronic circuits, microprocessors, sensors, and other components to process information, provide outputs, and often allow user interaction. Electronic device 118 come in various forms and serve diverse purposes across different industries and daily life. Electronic device 118 consist of various components, such as transistors, resistors, capacitors, and integrated circuits that enable the processing and manipulation of electrical signals. Many electronic devices 118 are powered by microprocessors or microcontrollers, which are central processing units designed to execute specific tasks or functions.

Electronic devices 118 typically have input interfaces to receive data or commands and output interfaces to provide information or perform actions. Common input methods include buttons, touchscreens, sensors and more. Electronic device 118 require a power source, often provided by batteries or direct electrical connections. Some devices may also incorporate energy-efficient features or use renewable power sources. Many electronic device 118 have user interfaces that allow interaction with the device. This can include screens, buttons, touchpads, keyboards, or other input/output mechanisms. Modern electronic devices 118 often feature connectivity options such as Wi-Fi, Bluetooth, USB, or other communication protocols to enable data exchange with other devices or networks. Mobile phones with advanced computing capabilities, touchscreen interfaces, and various built-in sensors. Portable computing devices with larger screens than smartphones, often used for multimedia and productivity applications. The term "electronic device" is broad and encompasses a wide range of products with diverse functionalities. The evolution of technology continually introduces new and innovative electronic devices that enhance communication, productivity, entertainment, and overall quality of life.

The software application 134 commonly referred to as an "app," is a computer program or set of programs designed to perform specific tasks or functions for end-users. These applications run on various computing devices, including computers, smartphones, tablets, and other electronic device 118. Software applications 134 are created to address specific needs, provide solutions, or enhance user experiences across a wide range of industries and purposes. Software applications 134 have graphical interfaces or command-line interfaces that allow users to interact with the program. UI design plays a crucial role in user experience. Each application is designed for a specific purpose or set of related tasks. The functionality may range from basic operations to complex processes depending on the application's intended use. Applications are often developed to run on specific operating systems (e.g., Windows, macOS, Android, IOS). Compatibility ensures seamless performance on the targeted platforms. Applications process data to perform tasks. This can involve data input, manipulation, storage, and output based on the application's purpose. Users interact with applications through various input methods, such as mouse clicks, keyboard inputs, touch gestures, or voice commands, depending on the platform and device. Many applications incorporate security measures including encoding data, to protect user data, prevent unauthorized access, and ensure the integrity of the application. Applications may include features for connecting to the internet, networks, or other devices to access data, receive updates, or provide collaborative functionality. Software application 134 are regularly updated to fix bugs, introduce new features, and enhance performance. Maintenance ensures the application remains compatible with evolving technologies. Applications like Google Chrome, Mozilla Firefox, or Safari designed for accessing and navigating websites on the internet. Applications like Microsoft Office (Word, Excel, Power Point) or Google Workspace for creating documents, spreadsheets, and presentations. Software application 134 play a crucial role in modern computing, enabling users to accomplish a diverse range of tasks efficiently and interact with digital content in various ways. The development and continual improvement of software applications contribute significantly to the advancement of technology and user experiences.

A communication unit 116, in the context of electronic devices 118, refers to a component or module that facilitates the exchange of data, information, or signals between different devices or systems. The primary purpose of a communication unit 116 is to enable seamless communication and interaction, often involving the transmission and reception of data through various communication protocols. This component is essential for devices to connect, share information, and coordinate functionalities. Communication units 116 support different connectivity protocols such as Wi-Fi, Bluetooth, Zigbee, NFC (Near Field Communication), or other wireless and wired communication standards. The choice of protocol depends on the specific requirements of the application. The communication unit 116 is responsible for transmitting and receiving data between devices. It manages the encoding, modulation, and demodulation of data to ensure reliable and efficient communication. The range and coverage of the communication unit 116 depends on the chosen communication protocol. For example, Wi-Fi provides a broader range suitable for connecting to a network, while Bluetooth is typically used for shorter-range device-to-device communication. Communication units 116 are integrated into electronic devices such as smartphones, tablets, IoT (Internet of Things) devices, and various other smart devices. These units are often embedded in the device's hardware or implemented as external modules. The communication unit 116 ensures interoperability between devices, allowing them to communicate seamlessly even if they are manufactured by different companies or operate on different platforms. Security features are often incorporated into communication units 116 to protect transmitted data from unauthorized access. Encryption, authentication, and secure communication protocols contribute to data security. Adherence to communication standards ensures that devices can communicate effectively. Standards like IEEE 802.11 for Wi-Fi or Bluetooth SIG standards for Bluetooth facilitate compatibility and interoperability. Depending on the application, communication units 116 may support real-time communication for applications that require low latency, such as voice calls or video streaming, or asynchronous communication for data synchronization. Some devices may have external communication ports, such as USB or Ethernet, for wired connectivity. The communication unit 116 manages communication through these ports. Examples of communication units include the wireless module in a smartphone, the Wi-Fi or Bluetooth module in a smart home device, or the communication interface in a networked industrial sensor. In summary, a communication unit is a fundamental component that empowers devices to communicate effectively in the digital world. The communication network 116 may correspond to a communication medium through which the electronic device 102, the water supply unit 110, the database 132 may communicate with each other. Such a communication may be performed in accordance with various wired and wireless communication protocols. Examples of such wired and wireless communication protocols include but are not limited to. Transmission Control Protocol and Internet Protocol (TCP/IP), User Datagram Protocol (UDP), Hypertext Transfer Protocol (HTTP), File Transfer Protocol (FTP), ZigBee, EDGE, infrared (IR), IEEE 802.11, 802.16, 2G, 3G, 4G, 5G, and 6G cellular communication protocols, and/or Bluetooth (BT) communication protocols. The communication network 104 may include, but is not limited to, the Internet, a cloud network, a Wireless Fidelity (Wi-Fi) network, a Wireless Local Area Network (WLAN), a Local Area Network (LAN), a telephone line (POTS), and/or a Metropolitan Area Network (MAN).

Database 132 is a structured collection of data that is organized and stored in a way that allows for efficient retrieval, updating, and management of information. It serves as a central repository for storing and managing data, making it easier to organize, access, and manipulate information for various purposes. Databases 132 are used in a wide range of applications, from simple personal data management systems to large-scale enterprise solutions. Tables are the fundamental structure in a database. They represent entities or objects and consist of rows and columns. Each row in a table is a record, and each column represents a specific attribute or field of the record. Rows, also known as records or tuples, represent individual entries in a table. Each row contains data related to a specific instance or entity. Columns, also known as fields or attributes, define the different properties or characteristics of the data stored in a table. Each column holds a specific type of information. Keys are used to uniquely identify records within a table. The primary key is a unique identifier for each record, and foreign keys establish relationships between tables. Relationships define connections between tables. For example, a customer table may have a relationship with an orders table through a common key, linking customers to their respective orders. Indexes improve the speed of data retrieval by creating a structured reference to the data. They are analogous to an index in a book, helping locate information more quickly. Queries are used to retrieve, manipulate, and analyze data from the database. SQL (Structured Query Language) is a common language for interacting with relational databases. A DBMS is software that manages the database. It provides an interface for users and applications to interact with the database, ensures data integrity, and handles tasks such as data storage, retrieval, and security. Use a tabular structure with predefined relationships between tables. Examples include MySQL, PostgreSQL, and Microsoft SQL Server. NoSQL Databases are designed to handle diverse and unstructured data. Examples include MongoDB (document-oriented), Cassandra (wide-column store), and Redis (key-value store). Object oriented databases store data in the form of objects, similar to object-oriented programming. Suited for applications with complex data structures. Graph Databases are designed for managing data with complex relationships, such as social networks. Examples include Neo4j and Amazon Neptune. Database operations adding new records or data into the database. Databases play a critical role in modern information systems, providing a structured and efficient way to store, manage, and retrieve data for various applications and industries.

Figure 2:
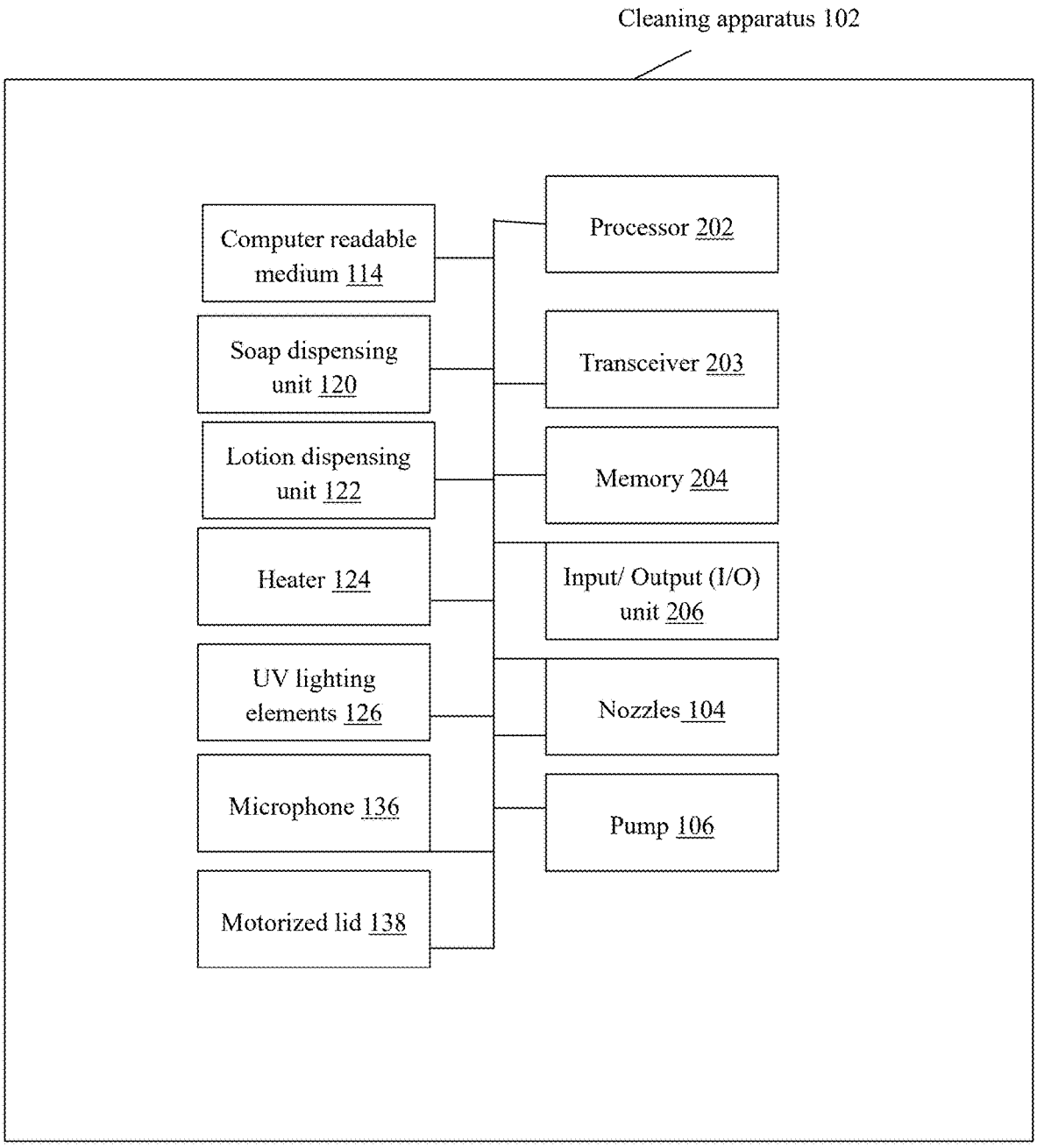
FIG. 2 is a block diagram that illustrates a cleaning apparatus configured to process the dictated instructions in accordance with an embodiment of the present disclosure.

FIG. 2 is a block diagram that illustrates the cleaning apparatus 102 configured to process the dictated instructions, in accordance with an embodiment of the present disclosure. FIG. 2 is explained in conjunction with elements from FIG. 1. Here, the cleaning apparatus 102 preferably includes a sensors 108, further sensors comprises image sensor 108*a* and proximity sensor 108*b*, a processor 202, Transceiver 203, Memory 204, Input/Output (I/O) unit 206, Nozzles 104, Pump 106, Computer readable medium 114, Soap dispensing unit 120, Lotion dispensing unit 122, Heater 124, UV lighting elements 126, Microphone 136, Motorized lid 138 is preferably communicatively coupled to each other and also to the communication network 116.

Sensor 108 is a device or instrument designed to detect and measure physical properties or changes in the environment and convert this information into signals or data. Sensors 108 play a crucial role in various technological applications, enabling the collection of data for analysis, control, and monitoring. There are numerous types of sensors 108, each designed to detect specific physical phenomena, such as light, temperature, motion, proximity, or images.

Image Sensor 108*a* is a specific type of sensor 108 that captures visual information and converts it into an electronic signal. It is commonly used in cameras and imaging devices to capture images or video. Image sensors 108*a* are crucial components in digital cameras, smartphones, surveillance cameras and other devices that require visual data capture. Image sensors 108*a* are utilized for facial recognition to identify users. Image sensors 108*a* also play a role in health monitoring by capturing visual information to detect unusual patterns on the user's hand and to allow that information to be sent to the user or the user's contact list.

Proximity sensor 108*b* a proximity sensor 108*b* is a type of sensors 108 that detects the presence or absence of an object or the proximity of an object within a certain range. Proximity sensors 108*b* are commonly used in electronic devices 118 to trigger actions when an object is nearby or to adjust settings based on the distance between the sensor 108 and an object. There are different types of proximity sensors 108*b*, and two common ones are infrared (IR) Proximity Sensor. IR proximity sensors emit infrared light and measure the reflection to determine the presence or absence of an object. These sensors 108 are often used in applications where contactless detection is required. Ultrasonic proximity sensors use sound waves to detect objects. Ultrasonic proximity sensors emit ultrasonic waves and measure the time it takes for the waves to bounce back. Ultrasonic proximity sensors are suitable for applications where accurate distance measurements are needed.

Processor 202 comprises suitable logic, circuitry, interfaces, and/or code that may be configured to execute a set of instructions stored in the memory 204. The processor 202 may be implemented based on a number of processor technologies known in the art. Examples of the processor 202 include, but not limited to, an X86-based processor, a Reduced Instruction Set Computing (RISC) processor, an Application-Specific integrated Circuit (ASIC) processor, a. Complex Instruction Set Computing (CISC) processor, and/or other processor. Comprises suitable logic circuitry interfaces and/or code that may be configured to execute a set of instructions stored in the memory 204 and may be implemented based on several processor technologies known in the art.

The processor 202 works in coordination with the Transceiver 203, input/output 206, Nozzles 104, pump 106, Computer readable medium 114, Soap dispensing unit 120, Lotion dispensing unit 122, Heater 124, UV lighting elements 126, Microphone 136. The processor 202 is involved in cleaning apparatus 102 processing within a communication unit 116. A processor, or central processing unit (CPU), is a crucial component in a computer system responsible for executing instructions and performing essential arithmetic and logical operations. Often considered the "brain" of a computer, the processor interprets and processes instructions, enabling the computer to perform various tasks. Arithmetic Logic Unit (ALU) is a fundamental part of the processor 202 responsible for executing arithmetic and logical operations. Processor 202 performs tasks like addition, subtraction, multiplication, division, and logical comparisons. The control unit manages the flow of data and instructions within the processor 202. Processor 202 fetches instructions from memory, decodes them, and directs the ALU and other components to execute the operations. Registers are small, high-speed storage locations within the processor used for temporarily holding data during processing. They play a crucial role in fast data access and manipulation Cache memory is a small, high-speed memory unit that stores frequently accessed instructions and data. Processor helps improve the speed of data retrieval by providing quick access to commonly used information. In the processor clock speed, measured in gigahertz (GHz), indicates how many cycles per second the processor can execute. Higher clock speeds usually result in faster processing, but other factors also influence overall performance. Modern processors often have multiple cores, allowing them to handle multiple tasks simultaneously. Each core functions as an independent processing unit, contributing to parallel processing and improved multitasking capabilities. Multithreading is a feature that enables a processor to execute multiple threads concurrently. Threads represent independent sets of instructions, and multithreading enhances efficiency by utilizing idle processing resources. Processors 202 often employ a pipeline architecture where different stages of instruction execution overlap. This strategy optimizes the use of the processor's resources and enhances overall throughput. Instruction set architecture defines the set of instructions that a processor can execute. Instruction set architecture includes commands for arithmetic operations, data movement and control flow. The control unit fetches instructions from the computer's memory, typically stored in RAM. The fetched instruction is decoded to understand the operation it represents. The ALU performs the specified operation, manipulating data based on the instruction. The results are written back to registers or memory, completing the instruction cycle. Types of processors includes (CISC) complex instruction set computing supports a large set of complex instructions. RISC (Reduced Instruction Set Computing), emphasizes a smaller set of simple instructions, aiming for higher performance. Superscalar processors execute multiple instructions simultaneously, enhancing performance through parallelism. Multicore processors include multiple processing cores on a single chip, improving multitasking capabilities. Another type of processor includes power efficiency modern processor which focuses on energy efficiency, balancing performance with power consumption. Another type of processor includes parallel processing which emphasises on parallel processing to enhance overall performance. In advanced manufacturing technology for manufacturing smaller nanometre processes is used. Use of manufacturing technology resulting in smaller and more power-efficient chips. Processors play a pivotal role in the functionality and performance of computers. Their constant evolution, incorporating advanced technologies, contributes to the continuous improvement of computing capabilities and overall user experiences.

A transceiver 203, short for "transmitter-receiver," is a device that combines both transmitting and receiving functions within a single unit. Transceiver is a key component in communication systems and networks, allowing for the bidirectional exchange of information. Transceivers are commonly used in various applications, including telecommunications, wireless communication, radio frequency (RF) systems, and networking. The transmitter component of a transceiver is responsible for converting electrical signals into a form suitable for transmission. Transceiver modulates the signals onto a carrier wave, preparing them for transmission through a communication medium such as air or a cable. The receiver component captures incoming signals from the communication medium, demodulates them, and converts them back into electrical signals for further processing. The receiver's role is crucial in extracting the transmitted information accurately. In wireless communication, a transceiver typically includes an antenna to facilitate the transmission and reception of electromagnetic waves. The antenna radiates the modulated signals during transmission and captures incoming signals during reception. The duplexer is often employed in transceivers to enable bidirectional communication over a single communication medium. Transceiver allows the transmitter and receiver to share the same antenna while preventing interference between the transmitted and received signals. In the transceiver frequency synthesizer is a circuit that generates stable and accurate carrier frequencies for the transmitter. Transceiver 203 ensures that the transmitted signals adhere to specified frequencies, facilitating efficient communication. The transceiver 203 includes a data interface that connects to the data source or destination. This interface enables the exchange of digital or analog information between the transceiver and external devices or systems. Modulation circuits in the transmitter modulate the information onto a carrier wave, while demodulation circuits in the receiver extract the original information from the received modulated signal. Radio transceiver is one of the type of the transceiver 203 used in radio communication systems, including two-way radios, walkie-talkies, and amateur radios. Wireless communication transceiver is another type of the transceiver 203, which is found in wireless communication devices such as Wi-Fi routers, Bluetooth devices, and cellular phones. In different types of transceivers fiber optic transceiver convert electrical signals into optical signals for transmission over fiber optic cables and vice versa. In a type of network transceiver which is commonly used in computer networks, such as Ethernet transceivers, to enable communication between network devices. In a type of satellite communication transceiver which is used in satellite communication systems for both uplink (transmitting to the satellite) and downlink (receiving from the satellite) communications. Transceivers play a crucial role in various wireless communication systems, including Wi-Fi, cellular networks, and satellite communication. In networking, transceivers are used in devices such as network interface cards (NICs) to enable communication over wired or wireless networks. In a type of radio transceivers which are widely used in amateur radio operations and for two-way communication in professional settings. Fiber optic transceivers is another type of transceiver which are employed in fiber optic communication systems, converting electrical signals to optical signals for transmission over fiber optic cables. Transceivers are versatile components that facilitate communication by integrating both transmission and reception functions. Their presence is ubiquitous in various communication systems, contributing to the seamless exchange of information across different applications and technologies.

Memory 204 in the context of computing refers to the electronic components that store and retrieve data for a computer system. Memory 204 plays a crucial role in the functioning of computers, allowing them to store and access information quickly and efficiently. There are several types of memory in a typical computer system, each serving different purposes. Primary Memory (RAM-Random Access Memory) RAM is volatile memory used for temporarily storing data and machine code currently being used and processed by the CPU. Memory 204 allows fast read and write operations, providing quick access to data. When the power is turned off, the data stored in RAM is lost. Another type of memory is Secondary Memory (Storage Devices-Hard Drives, SSDs). Secondary memory stores data for the long term, even when the power is turned off. Examples of secondary memory include hard drives, solid-state drives (SSDs), optical storage drives, and external storage devices. These devices have slower access times compared to RAM but offers larger storage capacities. Another type of memory is a cache memory, which is a small-sized type of volatile computer memory that provides high-speed data access to the processor. Memory 204 stores frequently used computer programs, applications, and data for quick retrieval. L1, L2, and L3 caches exist in modern processors, with L1 being the closest and fastest. Primary Memory (RAM) in Detail, DRAM (Dynamic RAM) is the most common type of RAM used in computers. DRAM requires constant refreshing to maintain data integrity. DRAM is faster than secondary memory but slower than SRAM. SRAM is faster and more expensive than DRAM. SRAM Does not require constant refreshing. SRAM is used in cache memory and some specific applications. Secondary memory is hard disk drives magnetic storage devices that use spinning disks to store data. These devices provide large storage capacities at relatively lower costs. These devices also offer slower access times compared to SSDs. In the solid-state drives there use N-AND-based flash memory used for data storage. They offer faster access times compared to HDDs, resulting in quicker system responsiveness. Memory 204 in a computer system is organized into a hierarchy, with different levels offering varying capacities, access times, and costs. The hierarchy typically includes registers, cache, primary memory (RAM), and secondary memory (storage devices). Memory 204 is a fundamental aspect of computing, enabling the storage and retrieval of data for various applications. The combination of different memory types in a computer system ensures a balance between speed, capacity, and cost, contributing to the overall performance and functionality of the system.

The Input/Output unit 206 is a crucial component within a computer system, facilitating seamless communication between the computer and external devices. Input units enable users to input data and instructions, while output units display or transmit processed information. The keyboard serves as a primary input device, accepting alphanumeric and special character inputs, supporting text-based data entry and command input. Input/Output unit 206 also captures two-dimensional motion and button clicks, enhancing user interaction with graphical interfaces by enabling pointing, clicking, and dragging actions. Alternatives to the mouse for cursor control, such as the touchpad and trackball, are also available. The input/output unit 206 comprises various input and output devices configured to communicate with the processor 202. Examples of input devices include, but are not limited to, the keyboard, mouse, joystick, touch screen, microphone, camera, and docking station. Output devices include, but are not limited to, the display screen and speaker.

Nozzle 104 serves the purpose of regulating and directing the flow of fluids, whether liquid or gas, across a multitude of fields, from engineering and manufacturing to everyday consumer goods. These devices come in diverse designs and functionalities, tailored to specific application needs. The orifice, a small aperture within the nozzle, serves as the entry point for fluid passage. Crucially, nozzles dictate fluid flow rate and direction. The throat, located just downstream of the orifice, acts as the narrowest point in the nozzle, accelerating fluid velocity. As fluid exits into the environment from the exit section, the nozzle's shape and design influence its behavior and spray pattern, with some featuring a converging-diverging structure, particularly useful for supersonic flows and propulsion systems. Materials like stainless steel, brass, aluminum, or plastics are commonly employed in nozzle construction, chosen based on application demands. Fluid spray nozzles, for instance, disperse liquids in fine mists or sprays, with applications ranging from agricultural pesticide spraying to manufacturing coatings and firefighting. Such nozzles produce focused, high-velocity fluid streams. In certain embodiments, they find use in water jets for cleaning, cutting, or propulsion purposes. Nozzle shape and design play pivotal roles in simulating specific aerodynamic conditions. Pressure washer nozzles, crucial in pressure washer systems, determine water spray patterns and pressures, often featuring various tips for different cleaning tasks. The design of these nozzles is influenced by desired flow rates and operating pressures, while material compatibility with handled fluids is paramount. Orifice and exit section dimensions shape spray patterns, while throat and exit section designs impact fluid jet velocity and characteristics. Given their exposure to high-pressure and abrasive environments, nozzles must endure wear and erosion. Versatile and indispensable, nozzles provide precise fluid control across diverse applications, offering tailored solutions in industries spanning agriculture, manufacturing, aerospace, and firefighting. Effective nozzle performance hinges on meticulous design, material selection, and alignment with specific application requirements.

Pump 106 is a mechanical device designed to move fluids (liquids or gases) from one location to another by increasing the fluid's pressure and imparting kinetic energy to it. Pumps are essential components in various industries, including water supply, wastewater treatment, oil and gas, chemical processing, and many others. They come in different types and configurations to suit specific applications. The impeller is a rotating component inside the pump that accelerates the fluid. Pump 106 consists of blades or vanes that impart kinetic energy to the fluid. The casing, also known as the pump housing, encloses the impeller and guides the fluid flow. Pump 106 plays a crucial role in creating a pressure difference and directing the fluid to the discharge. The inlet is where the fluid enters the pump, and the outlet is where the pressurized fluid exits. These ports are strategically located to facilitate the fluid's flow through the pump 106. Pump 106 is sealed. Sealed pump prevent leakage of fluid along the pump shaft, and bearings support the rotating components, reducing friction and ensuring smooth operation. The pump 106 is typically driven by an external power source, such as an electric motor, engine, or other prime movers. The drive mechanism transfers energy to the pump's impeller. Another type of pumps 106 includes centrifugal pumps. In a centrifugal pumps centrifugal force generated by a rotating impeller to move fluid. Centrifugal pumps are common in water supply systems, wastewater treatment, and various industrial processes. Another type of pumps is positive displacement pumps. Positive displacement pumps' working principle is to trap and move a fixed amount of fluid per cycle. Another type of pumps is reciprocating pumps. Reciprocating pumps are used in applications where precise flow control and high pressure are required, such as hydraulic systems and oil processing. One another type of pumps is the diaphragm pumps. The working principle of diaphragm pumps is to use a flexible diaphragm to move fluid through a chamber. Diaphragm pumps are suitable for pumping corrosive or abrasive fluids, pharmaceuticals, and food processing. Another type of pumps is jet pumps. Jet pumps working principle is to utilize the venturi effect to create a pressure difference and lift fluids. Jet pumps are common in water wells and residential water supply systems. Jet sprays are placed underwater to pump fluids from wells, tanks, or other submerged sources. Jet sprays are widely used in groundwater extraction, sewage pumping, and industrial applications. Axial flow pumps are another type of pumps. Axial flow pumps' working principle is to move fluid parallel to the pump shaft, generating axial flow. Axial flow pumps are commonly used in irrigation, flood control, and water treatment. In the type of axial pump's motor, or prime mover, drives the impeller, causing it to rotate within the pump housing. This rotation creates centrifugal force that flings the fluid outward from the impeller center. This outward motion of the fluid creates a low-pressure zone at the impeller's center, causing more fluid to be drawn in from the pump's inlet. The continuously rotating impeller propels the fluid through the pump housing and the increasing pressure forces the fluid out through the discharge port. The kinetic energy imparted by the impeller is thereby converted to pressure energy, resulting in a pressurized fluid discharge.

The Computer readable medium 114 also known as a storage medium or storage device, refers to any physical material or device that can store data in a form that can be read or accessed by a computer system. These mediums play a crucial role in data storage, retrieval, and transmission within computer systems. Various types of computer-readable media exist, each with its characteristics and applications. Types of computer-readable Media includes Hard Disk Drives (HDD). HDD includes magnetic storage devices with rotating disks. High-capacity, non-volatile, relatively fast access times. HDD is the primary storage for operating systems, applications, and user data. Another type of computer readable media is Solid-State Drives (SSD). SSD includes use of N-AND-based flash memory for data storage. SSD has faster access times, durability, and reliability compared to HDDs. SSD is the applications' primary storage and helps to improve system responsiveness. Another type of computer readable media is flash drives, USB drives. Flash drives are portable, non-volatile storage devices using flash memory. Flash drives are compact, lightweight, and removable. Flash drives use for data transfer, file storage, and portable applications. Another type of computer readable media is cloud storage. Cloud storage gives online storage service. Cloud storage is accessible via the internet. Cloud storage is remote, scalable, and often subscription based. Cloud storage is used for data backup, collaboration, and remote access.

Soap dispensing unit 120 is a device designed to dispense liquid soap or foam for hygiene purposes, typically in settings such as bathrooms, kitchens, or other locations where handwashing is necessary. These units are commonly found in public places, offices, hospitals, and homes to promote hand hygiene and prevent the spread of germs and infections. The soap dispensing unit 120 is a key component in maintaining cleanliness and ensuring effective handwashing. Soap dispensing unit 120 can use various mechanisms to release soap, including pump dispensers, touchless sensors, or manual levers. Touchless soap dispensers are becoming increasingly popular to minimize the risk of cross-contamination. Some soap dispensing units are designed to be refilled with liquid soap from bulk containers, while others use disposable soap cartridges or pouches. Soap dispensing unit 120 comes with adjustable settings to control the amount of soap dispensed with each use. Volume control in soap dispensing unit 120 helps optimize soap usage and reduces waste. Soap dispenser unit 120 come in various materials, including plastic, stainless steel, or other durable materials. The design of soap dispensing unit 120 can range from simple and utilitarian to stylish and aesthetically pleasing, depending on the intended setting. Soap dispensing unit 120 can be wall-mounted, placed on countertops, or integrated into sinks. Wall-mounted option for soap dispensing unit 120 is common in public restrooms, while countertop dispensers are suitable for kitchens and private bathrooms. Some dispensers have transparent windows or indicators to show the soap level, prompting timely refills. Touchless dispensers in soap dispensing unit 120 may require batteries or electrical connections via a wall outlet for sensor operation, while manual dispensers rely on mechanical levers. For soap dispensing unit 120. battery-operated units are convenient but require periodic battery replacement. Components of the soap dispensing unit 120 comprises soap reservoir which stored the liquid soap in the compartment. Soap reservoir can be an integral part of the dispenser or a refillable container. The dispensing mechanism in soap dispensing unit 120 is responsible for the releasing soap when activated. The dispensing mechanism in soap dispensing unit 120 also includes pump system, sensors, or manual levers. The volume control mechanism in soap dispensing unit 120 controls the amount of soap dispensed per use. In soap dispensing unit 120 battery compartment found in battery-operated dispensers, housing the batteries that power the dispenser's sensor. In a soap dispensing unit 120 transparent window or indicator allows users to see the remaining soap level and indicates when a refill is needed. Wall-mounted soap dispenser unit 120 comes with mounting hardware for secure installation. Countertop soap dispensing unit 120 may have anti-skid features or adhesive pads. In the soap dispensing unit 120 the sensor detects the presence of hands and triggers the release of soap. The sensor in soap dispensing unit 120 may use infrared technology to detect motion. Manual soap dispensing unit 120 typically has a lever or button that the user press to release soap. Manual soap dispensing unit 120 requires physical contact, so proper hand hygiene practices are essential. Refilling methods in soap dispensing unit 120 vary based on the design of the dispenser. Some soap units have a removable soap reservoir, while others require replacing disposable soap cartridges. Soap dispenser promotes hygiene in handwashing. Soap dispensing units 120 encourage regular handwashing, a crucial practice for preventing the spread of infections. Soap dispensing unit 120 minimizes contamination. Touchless soap dispensers help to reduce the risk of cross-contamination by eliminating the need for direct contact. Volume control settings and proper dispensing mechanisms in soap dispensing unit 120 ensure efficient use of soap and reduce waste. Dispensers are strategically placed in areas where hand hygiene is necessary, ensuring easy access for users.

Lotion dispensing unit 122 is a device designed to dispense liquid lotions or creams for skincare and moisturizing purposes. Lotion dispensers are similar to soap dispensers, lotion dispensers are commonly found in bathrooms, kitchens, and other settings where individuals may want to apply lotion to their skin. These units are particularly prevalent in homes, hotels, spas, and healthcare facilities. The primary purpose of a lotion dispenser unit 122 is to provide a convenient and hygienic way for individuals to access and apply lotion. Components of a lotion dispenser unit 122 comprises lotion reservoir. Lotion reservoir is the container or compartment that holds the liquid lotion. Lotion reservoir can be an integral part of the dispenser or a refillable container. The dispensing mechanism is responsible for releasing the lotion from the reservoir. This can take various forms, including pump systems, sensor-based mechanisms, or manual levers. The nozzle is the part of the dispenser through which the lotion is dispensed. Nozzles have a specific design to control the flow and prevent spillage of lotion. Some lotion dispensers have volume control settings or mechanisms that allow users to adjust the amount of lotion dispensed per use. This helps users to customize their application based on their preferences and needs. In touchless lotion dispensers, a sensor may be used to detect the presence of hands. When hands are detected, the sensor triggers the dispensing mechanism to release a predetermined amount of lotion. Battery compartment is similar to soap dispensers, some lotion dispensers are powered by batteries, especially touchless ones. The lotion dispenser unit 122 may also the connected to an electrical current via a wall outlet. The battery compartment houses the batteries that provide the necessary power for the sensor or motor. Transparent window is similar to soap dispensers, some lotion dispensers feature a transparent window or indicator that allows users to see the remaining lotion level. This helps prompt timely refills. Users can activate the lotion dispensing unit 122 through different means, depending on the type of dispenser. Touchless dispensers' users activate the dispenser by placing their hands within the sensor's detection range. Manual dispensers' users press a lever, button, or pump to dispense lotion. In touchless dispensers, when the sensor detects hands, sensor 108 sends a signal to the dispensing mechanism to release the lotion. The amount dispensed may be pre-set or adjustable based on user preferences. Manual dispensers require users to physically press a lever, button, or pump to release lotion. The user controls the amount dispensed by the pressure applied to the dispensing mechanism. Refilling methods of lotion dispensing unit 122 vary based on the design of the dispenser. Users can open the dispenser and pour liquid lotion directly into the reservoir. Some dispensers use disposable lotion cartridges that can be easily replaced when empty. Lotion dispensers provide a convenient way for individuals to apply skincare and moisturizing lotions to keep their skin hydrated and healthy. Hygiene and convenience similar to soap dispensers, lotion dispensers contribute to maintaining hygiene standards by providing a hands-free option for dispensing lotion. Touchless dispensers help minimize cross-contamination by eliminating the need for direct contact with the dispenser. Volume control settings allow users to customize the amount of lotion dispensed, catering to individual preferences and needs. The lotion dispenser may be free standing or integrated into the sink.

Heater 124 is a device that generates heat energy and raises the temperature of its surroundings. Heaters are commonly used for various purposes, including providing warmth in buildings, heating fluids in industrial processes, and maintaining comfortable temperatures in homes or commercial spaces. The type of heater and its specific mechanisms vary based on the intended application. Here, we'll explore the general principles and types of heaters commonly used for space heating. Types of heaters includes electric heaters and radiant heaters. Radiant heaters emit infrared radiation to heat objects directly. Radiant heaters are common for spot heating. Another type of heater is convective heater. Convective heater use a heating element to warm air, which then circulates in the room. Examples include fan heaters and oil-filled heaters. Another type of heater is a gas heater. Gas space heaters utilize natural gas or propane to generate heat. Types of gas heater includes vented and ventless (unvented) models. Another type of heater is the electric heater. The heating element in electric heater is crucial. Electric heaters could be a coil, resistor, or other materials that generate heat when an electric current passes through. Combustion chamber is present in gas and oil heaters, it is where fuel is burned to produce heat. The heater may be integrated into the sink or free standing. Heater 124 may be operated by batteries or connected to current through a wall outlet.

UV lighting elements 126 ultraviolet (UV) lighting refers to the use of ultraviolet electromagnetic radiation for various purposes, including disinfection, sterilization, scientific research, and specialized industrial applications. UV light falls outside the visible light spectrum, with wavelengths shorter than those of visible light, ranging from about 100 to 400 nanometers. UV light is categorized into three types based on wavelength. UV Light is used for disinfection and sterilization purposes due to its ability to inactivate microorganisms. UV light is highly effective in killing or inactivating microorganisms, including bacteria, viruses, and fungi. UV light is used in water treatment, air purification, and surface disinfection in various settings such as hospitals, laboratories, and public spaces.

Microphone 136 is a transducer that converts sound waves into electrical signals. Microphone 136 is an essential device used in various applications, including audio recording, communication systems, broadcasting, and speech recognition. Microphones 136 capture acoustic signals in the form of air pressure variations and convert them into electrical voltage, allowing the representation, amplification, and transmission of audio information. Components of a microphone 136 comprises the diaphragm is a thin, flexible membrane typically made of a lightweight material like plastic or metal. Diaphragm is the primary component that responds to changes in air pressure caused by sound waves. A backplate is a stationary plate placed close to the diaphragm. The distance between the diaphragm and the backplate affects the microphone's sensitivity and frequency response. The casing or housing protects the internal components of the microphone and provides a structure for mounting. The backplate is designed to minimize interference from external vibrations and electromagnetic fields. The combination of the diaphragm and backplate acts as an acoustic-to-electric transducer. When sound waves hit the diaphragm, it vibrates, causing changes in the distance between the diaphragm and backplate. In condenser microphones, the transducer mechanism involves a diaphragm and backplate forming a capacitor. Changes in the distance between the diaphragm and backplate alter the capacitance, generating an electrical signal. Dynamic microphones use a diaphragm attached to a coil of wire placed within the magnetic field of a magnet. When the diaphragm vibrates, it induces a voltage in the coil through electromagnetic induction. Some microphones, especially those with low output signals, may include an integrated preamplifier to boost the signal before it is transmitted to other audio devices. Dynamic microphones operate on the principle of electromagnetic induction. When sound waves hit the diaphragm, it vibrates, causing the coil of wire within a magnetic field to generate an electrical current. This current is the microphone's output signal. Condenser microphones operate based on changes in capacitance. The diaphragm and backplate form a capacitor. When sound waves cause the diaphragm to move, the capacitance changes, leading to the generation of an electrical signal. One of the type of microphone is a ribbon microphone, which are known for their smooth and natural sound reproduction and are often used for capturing nuances in vocals and instruments. USB microphones are designed for direct connection to computers via USB ports, eliminating the need for external audio interfaces. Often used for podcasting and online content creation.

A motorized lid 138 refers to a lid or cover that is equipped with a motorized mechanism 140 for opening, closing, or performing other movements. This component enhances the functionality and convenience of the cleaning apparatus by automating the operation of the lid. The lid is the protective covering of the cleaning apparatus, designed to enclose its internal components and contents. The depicted embodiment is a roll-out lid made of many individual linked segments which may be stowed within the motorized mechanism's housing when not in use. The motorized mechanism 140 consists of an electric motor and associated components responsible for opening, closing, or moving the lid. This mechanism may include gears, pulleys, belts, or other transmission systems to convert the motor's rotational motion into the desired movement of the lid.

One another component included in the motorized lid is a control system. The motorized lid is typically integrated into the overall control system of the cleaning apparatus. This control system governs the operation of the motorized mechanism, allowing users to initiate lid movements through user interfaces such as buttons, switches, or touch panels. Another component includes in the motorized lid is sensors. Some motorized lids may incorporate sensors to detect obstacles or monitor the lid's position. These sensors enhance safety by preventing the lid from closing on objects or fingers and ensure proper alignment during operation. Some motorized lids may incorporate sensors to detect obstacles or monitor the lid's position. These sensors enhance safety by preventing the lid from closing on objects or fingers and ensure proper alignment during operation. Motorized lid has multiple functions. The primary function of a motorized lid is to facilitate the opening and closing of the cleaning apparatus. Users can activate the motorized mechanism through the control system to conveniently access the interior of the apparatus for loading, unloading, or servicing. Another function of the motorized lid is automated operation, responding to user commands or predefined settings. For example, the lid may open automatically when the cleaning cycle starts and close once the cycle is complete, providing a hands-free experience for users. Another component of the motorized lid is adjustable speed and movement. Depending on the design of the motorized mechanism, the speed and movement of the lid may be adjustable. This flexibility allows users to customize the lid's operation according to their preferences or specific requirements. Motorized lids often include safety features to prevent accidents or damage. For instance, the control system may incorporate emergency stop functions or limit switches to halt lid movement if an obstruction is detected. In hygiene stations or handwashing systems, motorized lids can cover and uncover compartments containing soap, water, or other cleaning agents, providing convenient access for users while maintaining cleanliness and hygiene. They can seal and unseal these containers automatically, streamlining operations and ensuring safety. A motorized lid enhances the functionality, convenience, and safety of cleaning apparatus and other equipment by automating the opening, closing, or movement of the lid. With features such as adjustable speed, automated operation, and safety mechanisms, motorized lids provide users with a reliable and efficient solution for accessing and managing the contents of the apparatus.

In an exemplary operation, the process of cleaning apparatus is disclosed. In an embodiment, cleaning apparatus comprises a communication unit configured to an electronic device of the user. In an embodiment, cleaning apparatus comprises one or more nozzles. Nozzles are configured to spray at least one of water, soap, and lotion using a pump. The one or more nozzles are movable. In an embodiment, one or more sensors are configured to identify a user using the cleaning apparatus. In an embodiment, the one or more sensors comprises at least one of image sensors or proximity sensors. The one or more image sensors being configured to determine a position of the hands during a washing cycle and a drying cycle. At least one of the image sensors or the proximity sensors being configured to detect a presence of the user near the cleaning apparatus. The identification of the user is using one or more facial recognition techniques. In an embodiment, a speaker being configured to provide an audio-visual alert to the user. In an embodiment voice recognition may also be utilized to identify the user. In an embodiment, the audio-visual alert corresponds to one of a welcome greeting to the user or a goodbye to the user. In an embodiment, the one or more nozzles being configured to move in accordance with the position of the hands during the washing cycle and the drying cycle. The water supply unit connected to a water supply inlet and further to the one or more nozzles. The soap dispensing unit is configured to dispense soap on the hand of the user based on the input during washing of the hand. The lotion dispensing unit configured to dispense lotion on the hand of the user based on the input during washing of the hand. The drying element configured to dry one or more hands or objects placed within the cleaning apparatus. In an embodiment, the drying element is a heater. The UV lighting elements configured to sterilize the hand of the user after washing. In an embodiment, a plurality of jets of hots air and UV light being directed towards the hands of the user. User input will specify whether the user wishes to have both hot air and UV lighting during the hand drying process. In an embodiment, the plurality of configuration operations comprises detecting dirt in the sink to initiate a cleaning cycle at scheduled intervals. In an embodiment, water is prevented from escaping during the cleaning process. In an embodiment, the motorized lid of the cleaning apparatus moves into position to seal the sink. In an embodiment, a tight seal over the sink is created to contain water and cleaning agents within the cleaning apparatus. In an embodiment, a combination of soap, high pressure water jets, and a mixture of hot and cold water to effectively clean the sink is utilized. The water jets are directed to target specific areas with accumulated dirt or grime. In an embodiment, CCD imaging technology identifies areas in the sink that require cleaning. In an embodiment, cleaning cycle continues until sink is thoroughly cleaned, with the water jets and cleaning agents working together to remove dirt and stains from all surfaces. Once the cleaning cycle is complete, completion notification is received. In an embodiment, the user is notified via communication, indicating that the sink is now clean and ready for further use.

In an embodiment, one or more operation of the cleaning apparatus being controlled by a software application installed within an electronic device of the user. In an embodiment, the user performs a plurality of configuration operations associated with the cleaning apparatus. In an embodiment, the cleaning apparatus is configured to a plurality of configuration operations to provide a facial id or voice id for registration with the cleaning apparatus. The cleaning apparatus is configured to a plurality of configuration operations to providing a plurality of preferences associated with temperature of water, soap, lotion, audio, duration of time for handwashing, preferred time instant for self-cleaning of the cleaning apparatus, frequency of cleaning the cleaning apparatus, alerts, language, number of users, duration of time for UV lighting during handwashing, filters for screening, intensity of water. In an embodiment, the cleaning apparatus comprising a microphone configured to receive one or more instructions. In an embodiment, the cleaning apparatus is operated by electricity. In an embodiment, the cleaning apparatus comprises providing an alert to the user on an electronic device via the communication unit. In an embodiment, the alert is indicative of the detected one or more unusual patterns. In an embodiment, the alert is at least one of an SMS, a push notification, or an email. In an embodiment, the processor and the computer-readable medium communicatively coupled to the processor. In an embodiment, the computer-readable medium stores processor-executable instructions, which when executed by the processor, cause the processor to receive an input from a user for cleaning of hand. In an embodiment, the input is indicative of at least one of a thorough cleaning, a regular cleaning, and a quick wash. The computer-readable medium stores processor-executable instructions, which when executed by the processor, cause the processor to spray at least one of water, soap, and lotion using the one or more nozzles in a pre-defined pattern on the hand of the user. In an embodiment, the pre-defined pattern being associated with each of the input and to provide one or more feedback messages to the user after a washing cycle or drying cycle is completed.

The method for cleaning the hand of a user comprises receiving an input by a user for cleaning of hand. In an embodiment, the input is indicative of at least one of a thorough cleaning, a regular cleaning, and a quick wash. The cleaning apparatus is configured to identify a user using the cleaning apparatus using the sensors, such as image sensors. In an embodiment, the identification is using one or more sensors that comprises at least one of image sensors or proximity sensors. In an embodiment, the cleaning apparatus spray at least one of water, soap, and lotion using one or more nozzles in a pre-defined pattern on the hand of the user which was selected by the user. In an embodiment, the pre-defined pattern is associated with each of the inputs. For example, in this system, when the input is 'quick wash,' the predefined pattern may involve the nozzles moving once in a circular motion to cleanse the user's hand. However, when the input is 'thorough wash,' the predefined pattern could include the nozzles moving twice in a circular motion and twice in an X-shaped pattern, ensuring a more comprehensive cleansing of the user's hand. In an embodiment, the one or more nozzles being configured to spray at least one of water, soap, and lotion using a pump. In an embodiment, the one or more nozzles are movable, and the system provides feedback to the user after a washing cycle or drying cycle is completed. When the user is away from the cleaning apparatus, then the cleaning apparatus is by default in self-cleaning mode for a pre-determined time interval. In an embodiment, based on a structure of the cleaning apparatus. In an embodiment, the cleaning apparatus is configured to either spray hot water and/or cleaning fluid from the one or more nozzles that are positioned to remove dirt from the cleaning apparatus. In an embodiment, the one or more nozzles are micro driven and arranged to be positioned to spray where the dirt is located in the cleaning apparatus. The location of the dirt has been supplied by the ccd imaging devices. In an embodiment, the one or more image sensors being configured to detect one or more unusual patterns on the hand of the user using one or more machine learning techniques. In an embodiment, one or more unusual patterns comprises blood stains, tumor, vein patterns, mucus, or melanoma. In an embodiment, the one or more unusual patterns being stored in a database. In an embodiment, the one or more types of feedback messages consists of an audio feedback, a visual feedback, a haptic feedback, or a combination thereof. In an embodiment, the processor 202 of the cleaning apparatus may be configured to capture information on the user's hand washing habits. The information may comprise a count of hand washing, duration of wash, a frequency of hand washing, and the information may be stored in the memory 204, and optionally may be sent to the cloud and may be used for providing recommendations to improve sanitation habits of the user.

In an embodiment, the cleaning apparatus 102 may operate in a self-cleaning mode. The cleaning apparatus 102 may detect dirt using the sensors or it is preset to clean at a pre-defined time interval. The motorized lid seals the cleaning apparatus 102 and the self-cleaning process is initiated by utilizing soap, and the nozzles utilize high pressure hot and cold water spraying via the nozzles to clean the dirt in the cleaning apparatus 102. The self-cleaning process continues until the cleaning apparatus 102 is thoroughly clean. The user is then informed via a notification, such as an audible alert by communication that cleaning process has finished.

Figure 3:
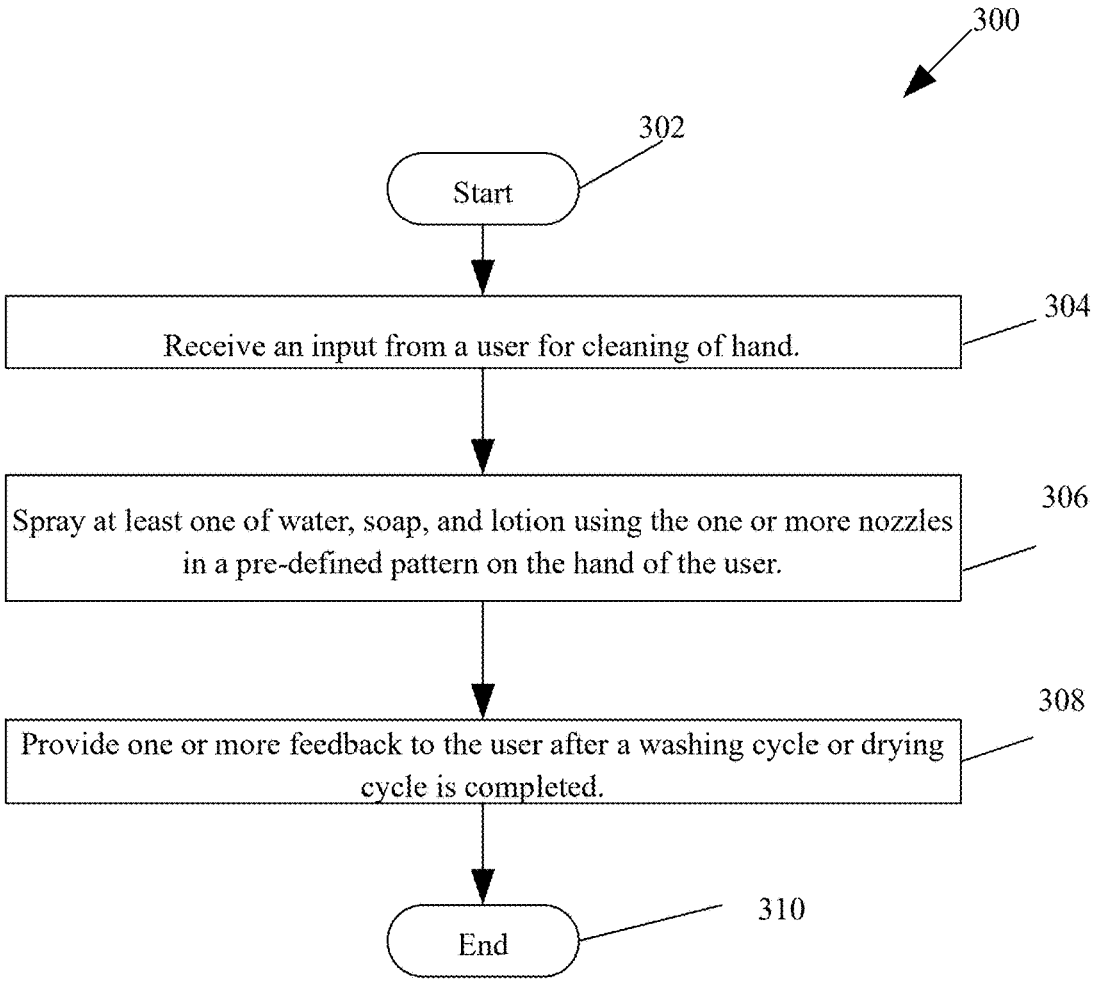
FIG. 3 is a flowchart that illustrates a method for the computer-readable medium that stores processor-executable instructions, in accordance with an embodiment of the present disclosure.

FIG. 3 is a flowchart that illustrates a method 300 for information execution by the processor, in accordance with an embodiment of the present disclosure. The method 300 may be performed by the cleaning apparatus 102. The method begins at Start step 302 and proceeds to step 304. At step 304, the processor of a cleaning apparatus 102 receives an input from a user for cleaning of hand. At step 306 the processor is configured to spray at least one of water, soap, and lotion using the one or more nozzles in a pre-defined pattern on the hand of the user. At step 308 the processor is configured to provide feedback to the user after a washing cycle or drying cycle is completed. Control passes to the end step 310.

Figure 4:
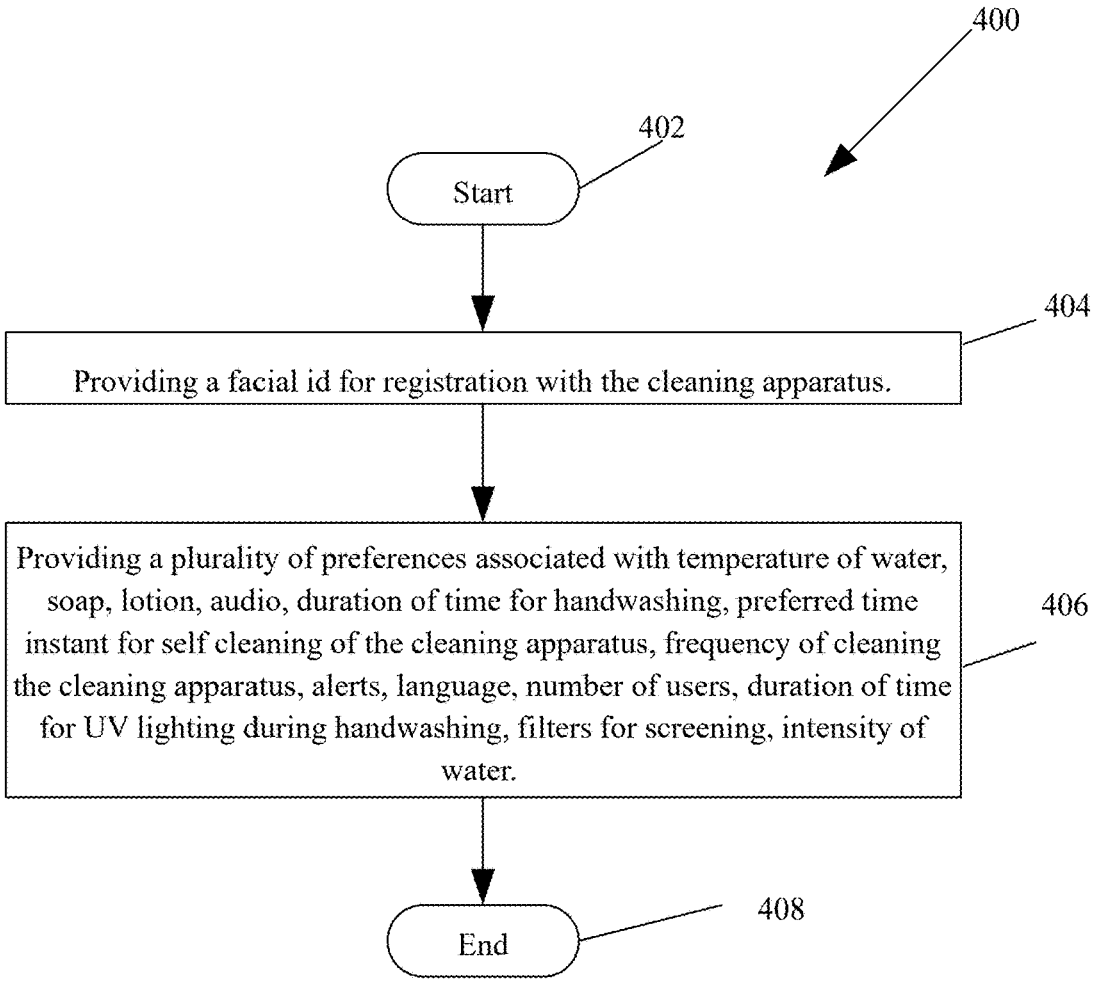
FIG. 4 is a flowchart that illustrates a method for the user to perform a plurality of configuration operations associated with the cleaning apparatus in accordance with an embodiment of the present disclosure.

FIG. 4 is a flowchart that illustrates a method 400 for cleaning apparatus 102, in accordance with an embodiment of the present disclosure. The method 400 may be performed by a cleaning apparatus. The method begins at Start step 402 and proceeds to end step 404. At step 404 the processor configured to provide a facial id for registration with the cleaning apparatus 102. The processor is configured to provide a plurality of preferences associated with temperature of water, soap, lotion, audio, duration of time for handwashing, preferred time instant for self-cleaning of the cleaning apparatus, frequency of cleaning the cleaning apparatus 102, alerts, language, number of users, duration of time for UV lighting during handwashing, filters for screening, intensity, and temperature of the water. Control passes to end step 408.

Figure 5:
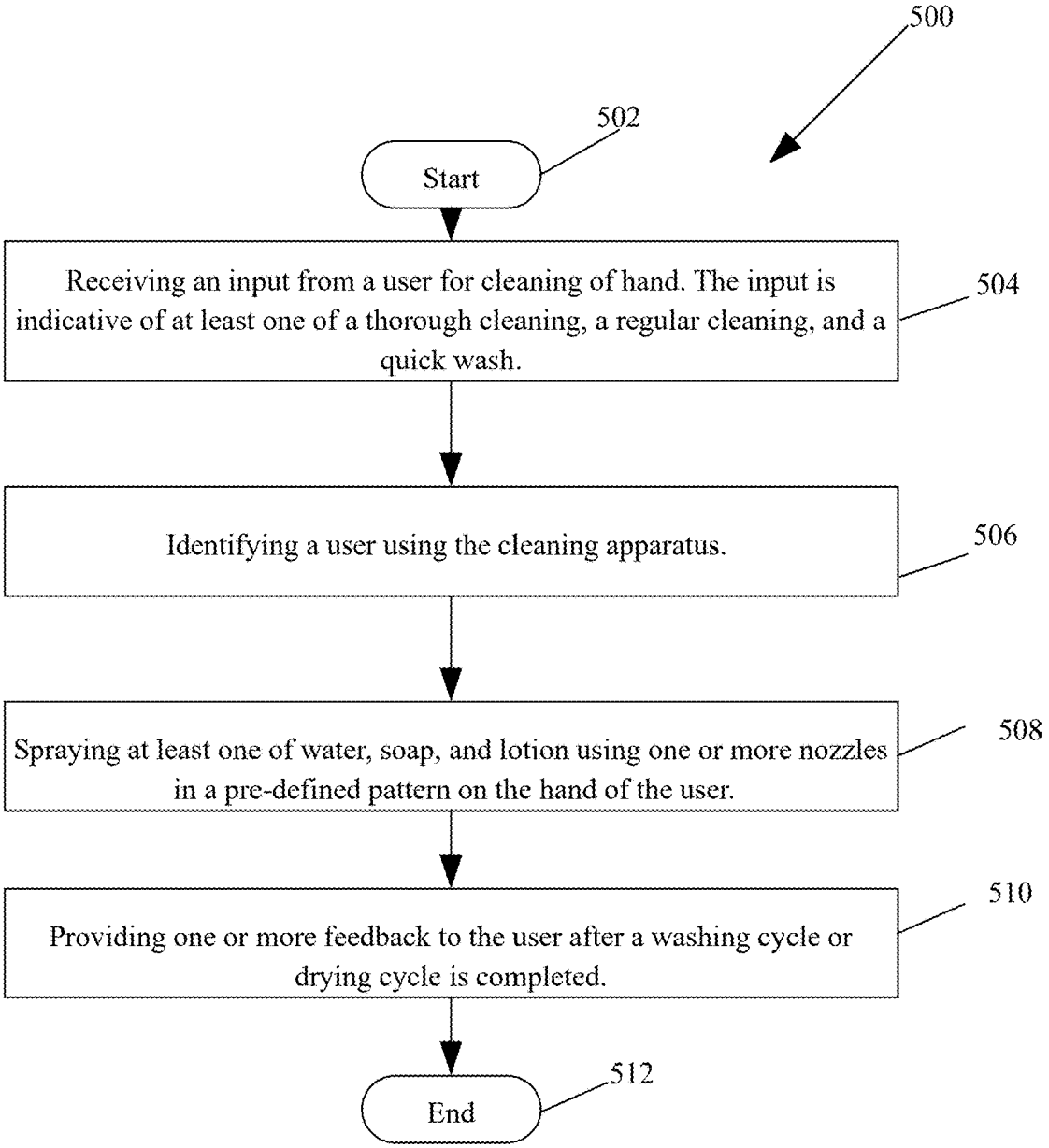
FIG. 5 is a flowchart that illustrates a method 500 for cleaning apparatus 102, in accordance with an embodiment of the present disclosure.

FIG. 5 is a flowchart that illustrates a method 500 for cleaning apparatus 102, in accordance with an embodiment of the present disclosure. The method 500 may be performed by a cleaning apparatus 102. The method begins at start step 502 and proceeds to end step 512. At step 504 the processor of cleaning apparatus 102 receive an input from a user for cleaning of hand. The input is indicative of either a thorough cleaning, a regular cleaning, or a quick wash. At step 506 the processor of the cleaning apparatus identifies a user using the cleaning apparatus. A step 508 processor of cleaning apparatus 102 sprays at least one of water, soap, and lotion using one or more nozzles in a pre-defined pattern on the hand of the user. A step 510 the processor of cleaning apparatus 102 provides feedback to the user after a washing cycle or drying cycle is completed. Control passes to the end step 512.

Figure 6:
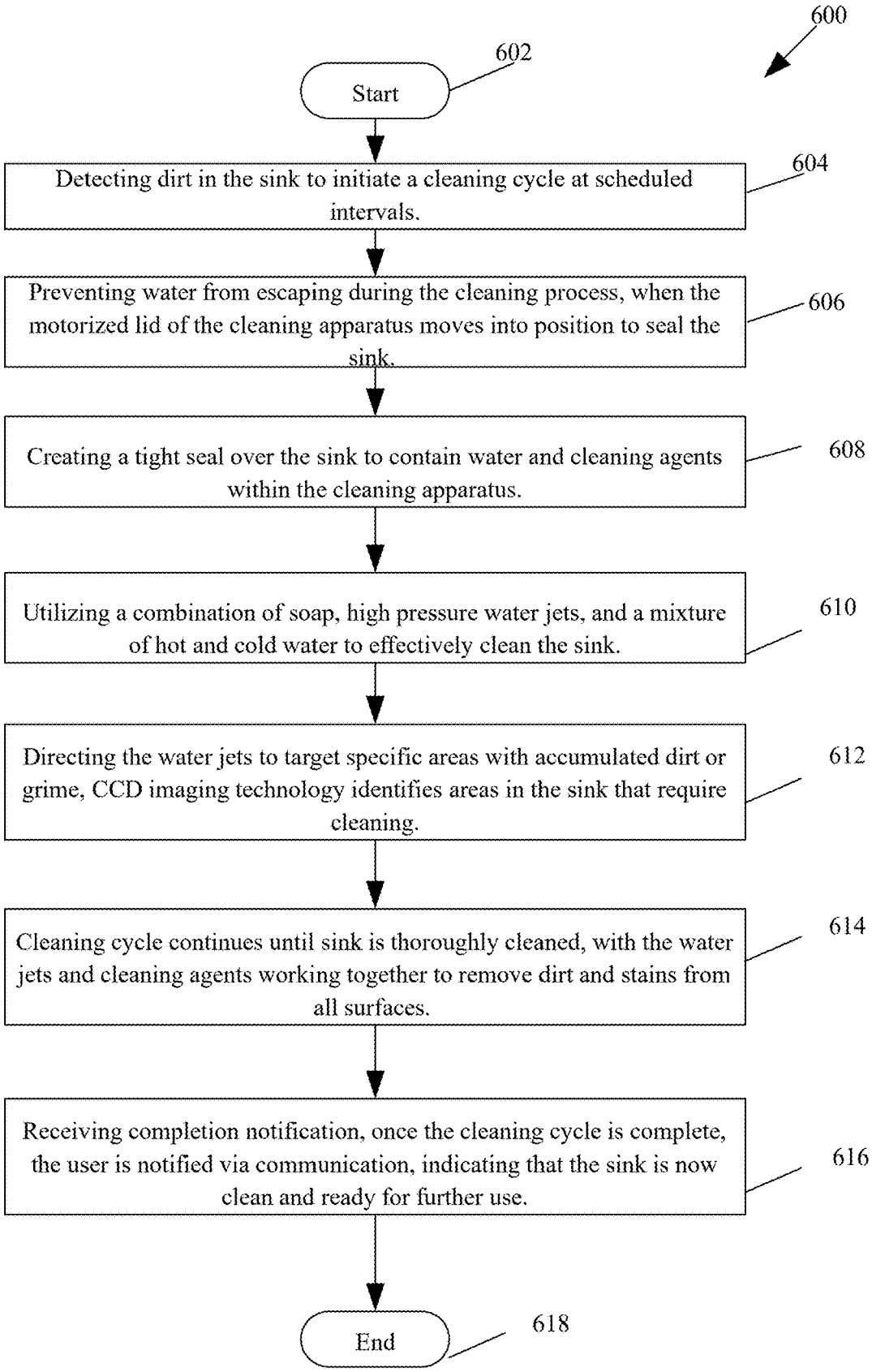
FIG. 6 is a flowchart that illustrated a method 600 for self-cleaning of cleaning apparatus 102, in accordance with an embodiment of the present disclosure.

FIG. 6 is a flowchart that illustrated a method 600 for self-cleaning of cleaning apparatus 102, in accordance with an embodiment of the present disclosure. The method 600 may be performed by a cleaning apparatus 102. The method begins at start step 602 and proceeds to end step 618. At the step 604 the processor of cleaning apparatus 102 detect dirt in the sink to initiate a cleaning cycle at scheduled intervals. At step 606 the processor of the cleaning apparatus 102 prevent water from escaping during the cleaning process, when the motorized lid 138 of the cleaning apparatus moves into position to seal the sink. At step 608 the processor of the cleaning apparatus 102 create a tight seal over the sink to contain water and cleaning agents within the cleaning apparatus. At step 610 the processor of the cleaning apparatus 102 utilize a combination of soap, high pressure water jets, and a mixture of hot and cold water to effectively clean the sink. At step 612 the processor of the cleaning apparatus 102 directs the water jets to target specific areas with accumulated dirt or grime, CCD imaging technology identifies areas in the sink that require cleaning. At step 614 the processor of the cleaning apparatus 102 cleaning cycle continues until sink is thoroughly cleaned, with the water jets and cleaning agents working together to remove dirt and stains from all surfaces. At step 616 the processor of the cleaning apparatus 102 receives completion notification, once the cleaning cycle is complete, the user is notified via communication, indicating that the sink is now clean and ready for further use. Control passes to end step 618.

Figure 7:
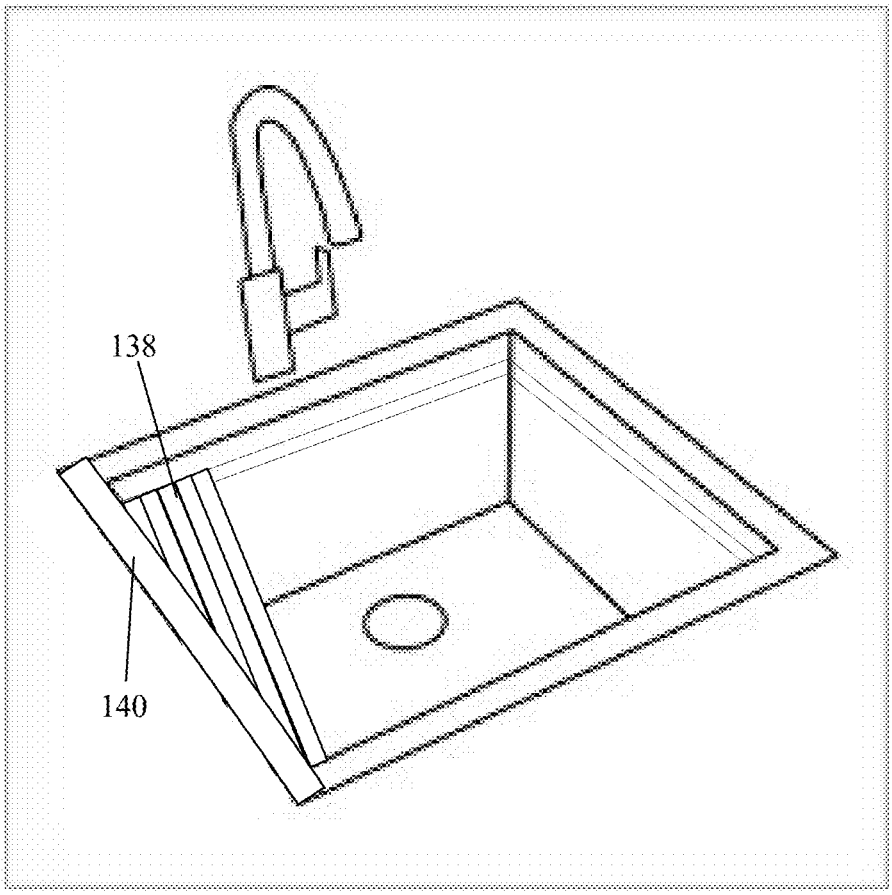
FIG. 7 is a diagram showing fully closed sink with lid, in accordance with an embodiment of the present disclosure.

FIG. 7 is a diagram showing a fully closed sink with lid, in accordance with an embodiment of the present disclosure. FIG. 7 illustrates a fully closed sink with a lid 138, showcasing one of the embodiments of the present disclosure. The main body of the sink, typically made of a durable material such as stainless steel or porcelain, is designed to hold water during handwashing and other activities. Lid 138 positioned on top of the sink basin; the lid serves multiple purposes. The lid features a sealing mechanism that enables it to cover the sink basin, effectively enclosing it during specific operations, such as cleaning cycles. Lid 138 can be transparent to observe cleaning cycles. The lid is operated by micro motors, allowing for smooth and controlled opening, and closing actions. The lid may include a rolling mechanism that allows the lid to be deployed and retracted seamlessly, ensuring ease of use and minimal interference with sink functionality. Micro Motors, small electric motors are integrated into the mechanisms controlling the lid and possibly other moving parts of the sink system. They provide the necessary power and precision to operate components such as the lid and dynamic nozzles smoothly and efficiently.

In a working but non-limiting example of the aforementioned disclosure, the following is a detailed working example illustrating the functionality and operation of the present disclosure. The described features aim to create a comprehensive and technologically advanced hand-cleaning apparatus. User Registration-user approaches the cleaning apparatus 102 and registers by providing a facial ID or voice recognition through the image/microphone sensors. The user accesses the software application on their electronic device and configures preferences, including water temperature, soap type, lotion type, washing time, and other parameters. Hand Cleaning Operation: The user selects a desired cleaning mode (thorough, regular, quick wash) through the interface on their electronic device or directly on the cleaning apparatus. Identification and Personalization: The image sensors and proximity sensors identify the user, allowing for a personalized hand-cleaning experience based on the configured user preferences. Automated Cleaning Process: Movable nozzles spray water, soap, or lotion in a predefined pattern on the user's hands, ensuring a systematic and efficient cleaning process. Feedback Mechanisms: throughout the cleaning process, the user receives feedback through audio, visual, and haptic signals, indicating the progress and completion of each phase. The soap dispensing unit releases a specific amount of soap based on user preferences during the washing cycle. Drying Element: After the washing cycle, a drying element, such as a heater, activates to efficiently dry the user's hands. UV Sterilization: UV lighting elements turn on to sterilize the user's hands after the washing and drying process. Unusual Pattern Detection:—Image sensors detect unusual patterns on the user's hands, such as blood stains or tumors, vein patterns, triggering a health alert. Alerts to User: The communication unit sends an alert to the user's electronic device, notifying them or their contact list of the detected unusual pattern and advising further action. Self-Cleaning Mode:—When the user is away, the cleaning apparatus 102 automatically enters a self-cleaning mode. Movable nozzles spray hot water and cleaning fluid to remove dirt, and the rolling cover seals the unit to create a self-contained cleaning environment. Energy Conservation: The self-cleaning mode is energy-efficient, contributing to overall energy conservation and device maintenance. The cleaning apparatus includes an innovative feature that monitors and analyzes user hand washing habits. This functionality is enabled by memory storage capabilities integrated into the apparatus. Throughout each hand washing session, relevant data is recorded, such as the frequency of hand washing, the duration of each session, and the user's selected cleaning preferences (thorough cleaning, regular cleaning, quick wash). Optionally, this data can be securely transmitted to cloud storage for further analysis and long-term tracking.

Utilizing advanced AI algorithms, the collected hand washing habits data undergoes comprehensive analysis. This analysis enables the generation of personalized recommendations and feedback aimed at enhancing sanitation habits and promoting better hand hygiene practices among users. By leveraging this feature, the cleaning apparatus not only ensures effective cleaning but also contributes to fostering healthier hygiene routines.

This working example demonstrates how the various features of the disclosure work together to provide a personalized, efficient, and technologically advanced hand-cleaning experience, incorporating health monitoring, feedback mechanisms, and self-maintenance capabilities. The actual implementation would require precise engineering and integration of these features to ensure seamless operation and user satisfaction. Sample working example: Smart Hand-Cleaning apparatus—The cleaning apparatus 102 is equipped with advanced sensors, a pump system, a communication unit, and various dispensing and sterilization mechanisms. User preferences include water temperature, soap type, lotion type, and other parameters. Health monitoring involves detecting blood stains, vein patterns, and tumors using image sensors. User Registration and Configuration: User approaches the cleaning apparatus. Facial ID is registered through image sensors. User configures preferences on the connected mobile app: Water temperature: 38° C. (100.4° F.), Soap type: Antibacterial, Lotion type: Aloe vera-infused, Hand Cleaning Operation: User selects "Thorough Cleaning" mode. Pump system activates, delivering water at the specified temperature and soap based on user preferences. Movable nozzles move in a predefined pattern, ensuring complete coverage. Dispensing parameters: Water spray duration: 20 seconds, Soap dispensing: 5 ml, Feedback Mechanisms: throughout the process, the user receives feedback, Audio: Completion beep after each phase, Visual: LED indicators show progress, Haptic: Vibration signalizes the end of the process. Advanced Hygiene Features: Soap and Lotion Dispensing: Antibacterial soap is dispensed during the washing cycle. Aloe vera-infused lotion is dispensed during the drying cycle. Drying Element: Heater activates for 30 seconds to dry the hands. UV Sterilization, UV lighting elements activate for 10 seconds after drying to sterilize the hands. Health Monitoring and Alerts: Image sensors detect unusual patterns: Blood stains or tumors trigger a health alert. Detected patterns and session data are stored in the database for future reference. Alerts to User: Communication unit sends an alert to the user's mobile app: "Unusual pattern detected. Please consult a healthcare professional." Self-Cleaning and Energy Efficiency: When the user is away for an extended period or dirt/stains are detected in the cleaning chamber (sink) self-cleaning mode activates. Movable nozzles spray hot water and cleaning fluid for 5 minutes. Rolling cover seals the unit. Energy consumption during self-cleaning: 50 watts. Data on cleaning session is stored locally in memory or sent to the cloud.

A person with ordinary skills in the art will appreciate that the systems, modules, and sub-modules have been illustrated and explained to serve as examples and should not be considered limiting in any manner. It will be further appreciated that the variants of the above disclosed system elements, modules, and other features and functions, or alternatives thereof, may be combined to create other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules, and are not limited to any particular computer hardware, software, middleware, firmware, microcode, and the like. The claims can encompass embodiments for hardware and software, or a combination thereof.

While the present disclosure has been described with reference to certain embodiments, it will be understood by those skilled in the art that various changes may be made, and equivalents may be substituted without departing from the scope of the present disclosure. In addition, many modifications may be made to adapt a particular situation or material to the teachings of the present disclosure without departing from its scope. Therefore, it is intended that the present disclosure is not limited to the particular embodiment disclosed, but that the present disclosure will include all embodiments falling within the scope of the appended claims.

What is claimed is:

1. A cleaning apparatus, comprising:

a set of one or more movable nozzles, at least one nozzle in the set being configured to spray at least one liquid from a group of liquids consisting of water, soap, and lotion, wherein the at least one nozzle is configured to spray the at least one liquid using a pump;

at least one sensor configured to identify a user using the cleaning apparatus, wherein the at least one sensor belongs to a group of sensors consisting of one or more of an image sensor and a proximity sensor;

a water supply unit connected to a water supply inlet and further in fluid communication with the at least one nozzle;

a motorized lid configured to facilitate opening and closing of the cleaning apparatus;

a processor; and a computer-readable medium communicatively coupled to the processor, wherein the computer-readable medium stores processor-executable instructions, which when executed by the processor, cause the processor to perform operations for executing a washing cycle, wherein the operations comprise:

receiving a single input from a user, wherein the single input is indicative of activating a motorized mechanism to open the motorized lid and at least one of user cleaning preferences for cleaning of a hand of the user, and wherein the at least one of user cleaning preferences includes a cleaning mode selected from a group of one or more cleaning modes;

spraying the at least one liquid, using the at least one nozzle, in a pre-defined pattern on the hand of the user, the pre-defined pattern including at least one of a circular pattern and an X-shaped pattern, wherein a number of times the pre-defined pattern is repeated and a pattern sequence in the pre-defined pattern are based on the selected cleaning mode associated with the single input; and providing feedback to the user after the washing cycle is complete.

2. The cleaning apparatus of claim 1, further comprising a communication unit configured to communicate with an electronic device of the user.

3. The cleaning apparatus of claim 1, further comprising a soap dispensing unit configured to dispense soap on the hand of the user based on the input during washing of the hand.

4. The cleaning apparatus of claim 1, further comprising a lotion dispensing unit configured to dispense lotion on the hand of the user based on the input during washing of the hand.

5. The cleaning apparatus of claim 1, further comprising a drying element configured to the hand placed within the cleaning apparatus, wherein the drying element is a heater.

6. The cleaning apparatus of claim 1, further comprising at least one UV lighting element configured to sterilize the hand of the user after washing.

7. The cleaning apparatus of claim 1, wherein the at least one sensor is further configured to determine a position of the hand during a washing cycle and a drying cycle, wherein the at least one nozzle is configured to move in accordance with the position of the hand during the washing cycle.

8. The cleaning apparatus of claim 1, wherein the at least one sensor is further configured to detect a presence of the user near the cleaning apparatus and the cleaning apparatus further comprises a speaker being configured to provide an audio-visual alert to the user.

9. The cleaning apparatus of claim 1, wherein when the user is away from the cleaning apparatus, the cleaning apparatus is in a self-cleaning mode for a pre-determined time interval, wherein the cleaning apparatus is configured to spray a liquid from the at least one nozzle that has been positioned to remove dirt from the cleaning apparatus.

10. The cleaning apparatus of claim 9, wherein the pre-determined time interval is determined based on an amount of dirt present in the cleaning apparatus as determined by using at least one image sensor and at least one machine learning technique.

11. The cleaning apparatus of claim 1, further configured to store information of a cleaning session of the user into a memory.

12. The cleaning apparatus of claim 1, wherein the at least one sensor includes an image sensor configured to detect an unusual pattern on the hand of the user using at least one machine learning technique, wherein the unusual pattern relates to one of blood stains, vein patterns, tumour patterns, mucus, and melanoma.

13. The cleaning apparatus of claim 12, wherein the processor is further configured to provide an alert to the user on an electronic device via a communication unit, wherein the alert is indicative of the detected unusual pattern.

14. The cleaning apparatus of claim 1, wherein at least one operation of the cleaning apparatus is controlled by a software application installed within an electronic device of the user.

15. The cleaning apparatus of claim 1, wherein the cleaning apparatus is associated with a plurality of configuration operations that comprises:

providing a biometric identity (id) for registration with the cleaning apparatus; and providing a plurality of preferences associated with at least one preference selected from a set of preferences consisting of a temperature of water, a need for soap, a need for lotion, a duration of time for handwashing, a preferred time instant for self-cleaning of the cleaning apparatus, a frequency of cleaning the cleaning apparatus, alerts, a language, a number of users, a duration of time for UV lighting during handwashing, filters for screening, and intensity of water.

16. The cleaning apparatus of claim 1, further comprising a microphone configured to receive at least one instruction.

17. A method for cleaning a hand of a user, the method comprising:

receiving a single input from a user during a washing cycle, wherein the single input is indicative of activating a motorized mechanism to open a motorized lid of a cleaning apparatus and at least one of user cleaning preferences for cleaning of a hand of the user, wherein the at least one of user cleaning preferences includes a cleaning mode selected from a group of one or more cleaning modes;

identifying the user using the cleaning apparatus, wherein the identification is made by using at least one sensor belonging to a group of sensors consisting of one or more of image sensors and proximity sensors;

spraying at least one liquid selected from a group of liquids consisting of water, soap, and lotion, using a set of one or more movable nozzles, at least one moveable nozzle from the set spraying the at least one liquid in a pre-defined pattern on the hand of the user, the pre-defined pattern including at least one of a circular pattern and an X-shaped pattern, wherein a number of times the pre-defined pattern is repeated and a pattern sequence in the pre-defined pattern are based on the selected cleaning mode associated with the single input, and wherein the at least one nozzle is configured to spray the at least one liquid using a pump; and providing feedback to the user after the washing cycle is complete.

18. The method of claim 17, further comprising determining a position of the hand during the washing cycle, wherein the at least one nozzle is configured to move in accordance with the position of the hand during the washing cycle.

* * * * *